US009020415B2

(12) United States Patent
Buehler et al.

(10) Patent No.: US 9,020,415 B2
(45) **Date of Patent: *Apr. 28, 2015**

(54) BONUS AND EXPERIENCE ENHANCEMENT SYSTEM FOR RECEIVERS OF BROADCAST MEDIA

(75) Inventors: Kai Buehler, Los Angeles, CA (US); Frederik Juergen Fleck, San Francisco, CA (US)

(73) Assignee: Project Oda, Inc., New York, NY (US)

( * ) Notice: Subject to any disclaimer, the term of this patent is extended or adjusted under 35 U.S.C. 154(b) by 389 days.

This patent is subject to a terminal disclaimer.

(21) Appl. No.: 13/100,884

(22) Filed: May 4, 2011

(65) Prior Publication Data

US 2011/0275311 A1 Nov. 10, 2011

Related U.S. Application Data

(60) Provisional application No. 61/331,195, filed on May 4, 2010, provisional application No. 61/332,587, filed on May 7, 2010, provisional application No. 61/347,737, filed on May 24, 2010, provisional application No. 61/360,840, filed on Jul. 1, 2010.

(51) Int. Cl.
*H04H 40/00* (2008.01)
*H04H 60/31* (2008.01)
(Continued)

(52) U.S. Cl.
CPC ..... *H04H 60/31* (2013.01); *H04H 60/58* (2013.01); *H04H 60/66* (2013.01)

(58) Field of Classification Search
CPC ... H04H 60/58; H04H 20/24; H04H 2201/13; H04H 60/31; H04H 60/43; H04H 60/44; H04H 60/56; H04H 60/66; H04H 20/22; H04H 60/37; H04H 60/51; H04H 60/65; H04H 60/74; H04H 60/91; H04H 60/68; H04N 21/40; H04N 21/8173; H04N 21/25841; H04N 2005/44556; H04N 21/25891; H04N 21/4334; H04N 21/44218; H04N 21/4532; H04N 21/458; H04N 21/472; H04N 21/47202; H04N 21/6582; H04N 21/8126; H04N 5/44543
USPC ..... 455/558, 556.1, 186.1, 161.2, 3.02, 455/3.06; 463/25–28, 16–22; 725/1, 24, 725/37–39, 41, 44–46, 61, 31, 86, 56
See application file for complete search history.

(56) References Cited

U.S. PATENT DOCUMENTS 2,776,374 A 1/1957 Iskenderian
3,651,471 A 3/1972 Haselwood et al.
(Continued)

FOREIGN PATENT DOCUMENTS

WO W08702773 5/1987
WO W09930488 6/1999
(Continued)

OTHER PUBLICATIONS

International Searching Authority, "Search Report and Written Opinion," issued in connection with International Application No. PCT/US13/20695, mailed on Mar. 26, 2013, 7 pages.
(Continued)

*Primary Examiner* — Sujatha Sharma
(74) *Attorney, Agent, or Firm* — Dunlap Codding, P.C.

(57) ABSTRACT

According to one aspect, embodiments of the invention provide a method for awarding incentives, the method comprising receiving, via a first interface of a server, audio signals from a user over a communication network, receiving, via a second interface of the server, audio signals from a plurality of broadcast channels over the communication network, comparing, by a processor in the server, the audio signals received from the user and the audio signals received from the plurality of broadcast channels, determining, by the processor, based on the act of comparing, that the audio signals from the user correspond to a program currently being broadcast on one of the plurality of broadcast channels, and in response to the act of determining, automatically awarding, by the processor, the user at least one incentive.

20 Claims, 12 Drawing Sheets

(51) Int. Cl.
*H04H 60/58* (2008.01)
*H04H 60/66* (2008.01)

(56) References Cited

U.S. PATENT DOCUMENTS 3,742,462 A 6/1973 Haselwood et al.
3,742,463 A 6/1973 Haselwood et al.
3,772,649 A 11/1973 Haselwood et al.
3,919,479 A 11/1975 Moon et al.
3,973,206 A 8/1976 Haselwood et al.
4,025,851 A 5/1977 Haselwood et al.
4,048,562 A 9/1977 Haselwood et al.
4,179,212 A 12/1979 Lahr
4,208,652 A 6/1980 Marshall
4,230,990 A 10/1980 Lert, Jr. et al.
4,286,255 A 8/1981 Siy
4,441,205 A 4/1984 Berkin et al.
4,450,531 A 5/1984 Kenyon et al.
4,495,644 A 1/1985 Parks et al.
4,547,804 A 10/1985 Greenberg
4,565,927 A 1/1986 Ragle
4,599,644 A 7/1986 Fischer
4,639,799 A 1/1987 Inoue
4,641,350 A 2/1987 Bunn
4,646,352 A 2/1987 Asai et al.
4,677,466 A 6/1987 Lert, Jr. et al.
4,697,209 A 9/1987 Kiewit et al.
4,718,106 A 1/1988 Weinblatt
4,739,398 A 4/1988 Thomas et al.
4,747,147 A 5/1988 Sparrow
4,750,034 A 6/1988 Lem
4,790,564 A 12/1988 Larcher et al.
4,797,937 A 1/1989 Tajima
4,857,999 A 8/1989 Welsh
4,888,638 A 12/1989 Bohn
4,918,730 A 4/1990 Schulze
4,945,412 A 7/1990 Kramer
4,955,070 A 9/1990 Welsh et al.
4,959,870 A 9/1990 Tachikawa
4,967,273 A 10/1990 Greenberg
5,019,899 A 5/1991 Boles et al.
5,023,929 A 6/1991 Call
5,159,667 A 10/1992 Borrey et al.
5,210,820 A 5/1993 Kenyon
5,245,533 A 9/1993 Marshall
5,327,520 A 7/1994 Chen
5,355,161 A 10/1994 Bird et al.
5,481,294 A 1/1996 Thomas et al.
5,504,518 A 4/1996 Ellis et al.
5,550,928 A 8/1996 Lu et al.
5,579,471 A 11/1996 Barber et al.
5,586,197 A 12/1996 Tsujimura et al.
5,617,506 A 4/1997 Burk et al.
5,729,742 A 3/1998 Harbinski et al.
5,799,098 A 8/1998 Ort et al.
5,805,746 A 9/1998 Miyatake et al.
5,852,823 A 12/1998 De Bonet
5,859,935 A 1/1999 Johnson et al.
5,901,178 A 5/1999 Lee et al.
5,913,205 A 6/1999 Jain et al.
5,918,223 A 6/1999 Blum et al.
6,035,055 A 3/2000 Wang et al.
6,041,133 A 3/2000 Califano et al.
6,092,069 A 7/2000 Johnson et al.
6,119,124 A 9/2000 Broder et al.
6,181,818 B1 1/2001 Sato et al.
6,195,447 B1 2/2001 Ross
6,202,151 B1 3/2001 Musgrave et al.
6,209,028 B1 3/2001 Walker et al.
6,263,505 B1 7/2001 Walker et al.
6,269,362 B1 7/2001 Broder et al.
6,397,198 B1 5/2002 Hoffman et al.
6,400,890 B1 6/2002 Nagasaka et al.
6,415,000 B1 7/2002 Hirzalla et al.
6,445,818 B1 9/2002 Kim et al.
6,445,822 B1 9/2002 Crill et al.
6,445,834 B1 9/2002 Rising, III
6,463,426 B1 10/2002 Lipson et al.
6,477,269 B1 11/2002 Brechner
6,496,228 B1 12/2002 Mc Gee et al.
6,502,105 B1 12/2002 Yan et al.
6,549,757 B1 4/2003 Masse et al.
6,574,378 B1 6/2003 Lim
6,607,136 B1 * 8/2003 Atsmon et al. ..... 235/492
6,633,654 B2 10/2003 Hannigan et al.
6,721,449 B1 4/2004 Krishnamachari
6,901,378 B1 5/2005 Linker et al.
6,938,157 B2 8/2005 Kaplan
6,990,453 B2 1/2006 Wang et al.
6,995,309 B2 2/2006 Samadani et al.
6,999,715 B2 2/2006 Hayter et al.
7,035,742 B2 4/2006 Klefenz et al.
7,039,931 B2 5/2006 Whymark
7,042,525 B1 5/2006 Yu
7,228,293 B2 6/2007 De Treville
7,263,485 B2 8/2007 Wark
7,280,970 B2 10/2007 Tamir et al.
7,392,233 B2 6/2008 Tanaka
7,434,243 B2 10/2008 Lyda
7,706,838 B2 4/2010 Atsmon et al.
7,730,506 B1 6/2010 Lyda
7,991,770 B2 8/2011 Covell et al.
8,411,977 B1 4/2013 Baluja et al.
8,441,977 B2 5/2013 Min et al.
8,442,125 B2 5/2013 Covell et al.
8,479,255 B2 7/2013 Brauel et al.
8,732,739 B2 5/2014 Sillerman
2001/0044719 A1 11/2001 Casey
2002/0023220 A1 2/2002 Kaplan
2003/0003990 A1 * 1/2003 Von Kohorn ..... 463/25
2004/0255322 A1 12/2004 Meadows et al.
2005/0063667 A1 3/2005 Herley
2005/0147256 A1 7/2005 Peters et al.
2005/0198317 A1 * 9/2005 Byers ..... 709/228
2005/0234771 A1 * 10/2005 Register et al. ..... 705/14
2006/0020963 A1 1/2006 Weinblatt et al.
2006/0253330 A1 11/2006 Maggio et al.
2006/0282317 A1 12/2006 Rosenberg
2007/0055500 A1 3/2007 Bilobrov
2007/0100699 A1 * 5/2007 Ajizadeh ..... 705/14
2007/0100941 A1 5/2007 Lee et al.
2007/0124757 A1 5/2007 Breen
2007/0143778 A1 6/2007 Covell et al.
2007/0280638 A1 12/2007 Aoki et al.
2007/0283380 A1 12/2007 Aoki et al.
2008/0071537 A1 3/2008 Tamir et al.
2008/0082995 A1 4/2008 Tanaka et al.
2008/0201461 A1 8/2008 Yoshiuchi
2008/0276279 A1 11/2008 Gossweiler et al.
2009/0077578 A1 3/2009 Steuer et al.
2009/0132894 A1 5/2009 Xu et al.
2009/0234889 A1 9/2009 Dupree
2009/0248700 A1 10/2009 Amano et al.
2009/0254933 A1 10/2009 Gupta et al.
2009/0276802 A1 11/2009 Amento et al.
2009/0293079 A1 11/2009 McKee et al.
2009/0300143 A1 12/2009 Musa et al.
2010/0017455 A1 1/2010 Svendsen et al.
2010/0037277 A1 2/2010 Flynn-Ripley et al.
2010/0064307 A1 * 3/2010 Malhotra et al. ..... 725/24
2010/0088156 A1 4/2010 Wilson
2010/0094686 A1 4/2010 Henshaw et al.
2010/0095326 A1 4/2010 Robertson, III
2010/0099446 A1 4/2010 Panigrahi et al.
2010/0100417 A1 * 4/2010 Nussel et al. ..... 705/10
2010/0153999 A1 * 6/2010 Yates ..... 725/39
2010/0162312 A1 * 6/2010 Heilbron et al. ..... 725/43
2010/0169153 A1 7/2010 Hwacinski et al.
2010/0169917 A1 7/2010 Harboe et al.
2010/0256976 A1 10/2010 Atsmon et al.
2011/0035035 A1 2/2011 Khan et al.
2011/0078719 A1 3/2011 Kenyon et al.
2011/0082807 A1 4/2011 Parekh et al.
2011/0113439 A1 * 5/2011 Delegue et al. ..... 725/1

(56) References Cited

U.S. PATENT DOCUMENTS

| | | | | |
|---|---|---|---|---|
| 2011/0209191 | A1 | 8/2011 | Shah | |
| 2011/0307399 | A1* | 12/2011 | Holmes | 705/319 |
| 2012/0173320 | A1* | 7/2012 | Kail et al. | 705/14.4 |
| 2012/0184372 | A1 | 7/2012 | Laarakkers et al. | |
| 2013/0067515 | A1 | 3/2013 | Barish | |

FOREIGN PATENT DOCUMENTS

| | | | |
|---|---|---|---|
| WO | WO0007330 | | 2/2000 |
| WO | WO0106440 | A1 | 1/2001 |
| WO | WO0217539 | A2 | 2/2002 |

OTHER PUBLICATIONS

Abe et al., "Content-Based Classification of Audio Signals Using Source and Structure Modeling," HNC Development Center, Sony Corporation, Tokyo, Japan, pp. 1-4. Last Accessed, Nov. 11, 2013.

Adjeroh et al., "Multimedia Database Management—Requirements and Issues," The Chinese University of Hong Kong, IEEE MultiMedia, Jul.-Sep. 1997, pp. 24-33.

Ahuja et al., "Extraction of Early Perceptual Structure in Dot Patterns: Integrating Region, Boundary, and Component Gestalt," Coordinated Science Laboratory, University of Illinois at Urbana-Champaign, Urbana, IL, USA, Computer Vision, Graphics and Image Processing 48, (1989), pp. 304-356.

Allan et al., "On-line New Event Detection and Tracking," Center for Intelligent Information Retrieval, Computer Science Department, University of Massachusetts, Amherst, MA, USA, SIGIR '98, Melbourne, Australia 1998 ACM 1-58113-015-5 8/98, pp. 37-45.

Ardizzo et al., "Content-Based Indexing of Image and Video Databases by Global and Shape Features," Universita di Palermo, Dipartimento di Ingegneria Elettrica, Palermo, Italy, 1996 IEEE, Proceedings of ICPR '96, pp. 140-144.

Bainbridge et al., "Towards a Digital Library of Popular Music," University of Waikato, Hamilton, New Zealand & Rutgers University, New Jersey, USA, pp. 1-9. Last Accessed, Nov. 11, 2013.

Bigün et al., "Orientation Radiograms for Image Retrieval: an Alternative to Segmentation," Signal Processing Laboratory, Swiss Federal Institute of Technology, Lausanne, Switzerland, 1996 IEEE, Proceedings of ICPR '96, pp. 346-350.

Campbell et al., "Copy Detection Systems for Digital Documents," Brigham Young University, Department of Computer Science, Provo, UT, USA, 0-7695-0659-3/00, 2000 IEEE, pp. 1-11.

Cano et al., "Score-Performance Matching using HMMs," Audiovisual Institute, Pompeu Fabra University, Barcelona, Spain, pp. 1-4. Last Accessed, Nov. 11, 2013.

Cantoni et al., "Recognizing 2D Objects by a Multi-Resolution Approach," Dipartimento di Informatica e Sistemistica, Universita di Pavia, Italy, 1051-4651/94 1994 IEEE, pp. 310-316.

Carson et al., "Blobworld: A System for Region-Based Image Indexing and Retrieval," EECS Department, University of California, Berkeley, CA, USA, Dionysius P. Huijsmans, Arnold W.M. Smeulders (Eds.): Visual '99, LNCS 1614, 1999, pp. 509-517.

Cha et al., "Object-Oriented Retrieval Mechanism for Semistructured Image Collections," Department of Multimedia Engineering, Tongmyong University of Information Technology, Pusan, South Korea, ACM Multimedia '98, Bristol, UK, pp. 323-332.

Chang et al., "Extracting Multi-Dimensional Signal Features for Content-Based Visual Query," Department of Electrical Engineering & Center for Telecommunications Research, Columbia University, New York, NY, USA, SPIE Symposium on Visual Communications and Signal Processing, May 1995, pp. 1-12.

Chang et al., "Multimedia Search and Retrieval," Columbia University, Department of Electrical Engineering, New York, NY, USA, Published as a chapter in Advances in Multimedia: Systems, Standards, and Networks, A Puri and T. Chen (eds.), New York: Marcel Dekker, 1999, pp. 1-28.

Chen et al., "Content-based Video Data Retrieval," Department of Computer Science, National Tsing Hua University, Taiwan, R.O.C., Proc. Natl. Sci. Couns. ROC(A) vol. 23, No. 4, 1999, pp. 449-465.

Christel et al., "Evolving Video Skims Into Useful Multimedia Abstractions," Carnegie Mellon University, Pittsburgh, PA, USA, CHI 98 Apr. 18-23, 1998, pp. 171-178.

Christel et al., "Multimedia Abstractions for a Digital Video Library," HCI Institute and CS Dept., Carnegie Mellon University, Pittsburgh, PA, USA, in Proceedings of ACM Digital Libraries '97 Conference, Philadelphia, PA, USA, Jul. 1997, pp. 21-29.

Colombo et al., "Retrieval of Commercials by Video Semantics," 1998 IEEE Computer Society Conference on Computer vision and Pattern Recognition, Jun. 23-25, 1998, Santa Barbara, CA, USA, pp. 1-17.

De Gunst et al., "Knowledge-Based Updating of Maps by Interpretation of Aerial Images," Delft University of Technology, Fac. of Geodetic Engineering, The Netherlands, 1051-4651/94 1994 IEEE, pp. 811-814.

Faloutsos et al., "Efficient and Effective querying by Image Content," Department of Computer Science, University of Maryland, MD, USA, Journal of Intelligent Information Systems, 3, 231-161 (1994), pp. 231-262.

Flickner et al., "Query by Image and Video Content: The QBIC System," IBM Almaden Research Center, 1995 IEEE, Sep. 1995, pp. 23-32.

Foote, "Content-Based Retrieval of Music and Audio," Institute of Systems Science, National University of Singapore, Heng Mui Keng Terrace, Kent Ridge, Singapore, pp. 1-10. Last Accessed, Nov. 11, 2013.

Foote, "Automatic Audio Segmentation Using a Measure of Audio Novelty," FX Palo Alto Laboratory, Inc., pp. 1-4. Last Accessed, Nov. 11, 2013.

Fujiwara et al., "Dynamic Miss-Counting Algorithms: Finding Implication and Similarity Rules with Confidence Pruning," Hitachi Ltd., Central Research Laboratory, pp. 1-11. Last Accessed, Nov. 11, 2013.

Gerhard, "Ph.D. Depth Paper: Audio Signal Classification," School of Computing Science, Simon Fraser University, Burnaby, BC, Canada, Feb. 23, 2000, pp. 1-46.

Gong et al., "An Image Database System with Content Capturing and Fast Image Indexing Abilities," School of Electrical and Electronic Engineering, Nanyang Technological University, Singapore, 1994 IEEE, pp. 121-130.

Gudivada et al., "Content-Based Image Retrieval Systems," Ohio University, Ohio, USA, 1995 IEEE, pp. 18-22.

Gunsel et al., "Similarity Analysis for Shape Retrieval by Example," Dept. of Electrical Engineering and Center for Electronic Imaging Systems, University of Rochester, Rochester, NY, USA, 1015-4651/96 1996 IEEE, Proceedings of ICPR '96, pp. 330-334.

Jansen et al., "Searching for multimedia: analysis of audio, video and image Web queries," Computer Science Program, University of Maryland (Asian Division), Seoul, Korea, World Wide Web 3: 249-254, 2000, pp. 249-254.

Konstantinou et al., "A Dynamic JAVA-Based Intelligent Interface for Online Image Database Searches," School of Computer Science, University of Westminster, London, U.K., Dionysius P. Huijsmans, Arnold W.M. Smeulders (Eds.): Visual '99, LNCS 1614, 1999, pp. 211-220.

Kroepelien et al., "Image Databases: A Case Study in Norwegian Silver Authentication," Dept. of Cultural Studies and Art History, University of Bergen, Bergen, Norway, 1996 IEEE, Proceedings of ICPR '96, pp. 370-374.

Lee et al., "Indexing for Complex Queries on a Query-By-Content Image Database," IBM Almaden Research Center, San Jose, CA, USA, 1051-4651/94, 1994 IEEE, pp. 142-146.

Lee et al., "Reliable On-Line Human Signature Verification System for Point-of-Sales Applications," Faculdade de Engenharia Eletrica, Universidade Estadual de Campinas, Campinas, Brazil, 1051-4651/94,1994 IEEE, pp. 19-23.

Li et al. "Content-Based Audio Classification and Retrieval Using the Nearest Feature Line Method," Microsoft Research China, pp. 1-12. Last Accessed, Nov. 11, 2013.

(56) References Cited

OTHER PUBLICATIONS

Li et al., "C-BIRD: Content-Based Image Retrieval from Digital Libraries Using Illumination Invariance and Recognition Kernel," School of Computing Science, Simon Fraser University, Burnaby, B.C., Canada, pp. 1-6. Last Accessed, Nov. 11, 2013.
Li et al., "Illumination Invariance and Object Model in Content-Based Image and Video Retrieval," School of Computing Science, Simon Fraser University, Burnaby, B.C., Canada, Journal of Visual Communications and Image Representation 10, (1999), pp. 219-244.
Lienhart et al., "Video Abstracting," University of Mannheim, Mannheim, Germany, Communications of ACM, pp. xx-yy, Dec. 1997, pp. 1-12.
Lienhart et al., "VisualGREP: A Systematic Method to Compare and Retrieve Video Sequences," Universitat Mannheim, Germany, Accepted for publication in Kluwer Multimedia Tools and Applications, 1998, pp. 1-21.
Liu et al., "An Approximate String Matching Algorithm for Content-Based Music Data Retrieval," Department of Computer Science, National Tsing Hua University, Taiwan, R.O.C., pp. 1-6. Last Accessed, Nov. 11, 2013.
Liu et al., "Audio Feature Extraction and Analysis for Scene Segmentation and Classification," Polytechnic University, Brooklyn, NY, USA, pp. 1-39. Last Accessed, Nov. 11, 2013.
Loscos et al., "Low-Delay Singing Voice Alignment to Text," Audio-visual Institute, Pompeu Fabra University, Barcelona, Spain, Published in the Proceedings of the ICMC99, pp. 1-5.
Ma et al., "NeTra: A toolbox for navigating large image databases," Hewlett-Packard Laboratories, Palo, Alto, CA, USA, Multimedia Systems 7: (1999), pp. 184-198.
Mel et al., "SEEMORE: A View-Based Approach to 3-D Object Recognition Using Multiple Visual Cues," Department of Biomedical Engineering, University of Southern California, Los Angeles, CA, USA, 1015-4651/96 1996 IEEE, Proceedings of ICPR '96, pp. 570-574.
Melih et al., "An audio representation for content based retrieval," Griffith University, IEEE Region 10 Annual International Conference, Proceedings: Speech and Image Technologies for computing and Telecommunications, 1997, pp. 207-210.
Mohan et al., "Using Perceptual Organization to Extract 3-D Structures," IEEE Transactions on Pattern Analysis and Machine Intelligence, vol. II, No. 11, Nov. 1989, pp. 1121-1139.
Nam et al., "Dynamic Video Summarization and Visualization," Department of Electrical and Computer Engineering, University of Minnesota at Twin Cities, Minneapolis, MN, USA, ACM Multimedia '99 (Part 2) Oct. 1999, Orlando, FL, USA, pp. 53-56.
Niblack et al., "The QBIC Project: Querying Images by Content Using Color, Texture, and Shape," IBM Research Division, Almaden Research Center, San Jose, CA, USA, SPIE vol. 1908 (1993), pp. 173-187.
Ogle et al., "Chabot: Retrieval from a Relational Database of Images," University of California at Berkeley, Berkeley, CA, USA, pp. 1-18. Last Accessed, Nov. 11, 2013.
Ortega et al., "Supporting Ranked Boolean Similarity Queries in MARS," IEEE, Issue 6, Nov./Dec. 1998, pp. 1-13.
Ortega et al., "Supporting Similarity Queries in MARS," Department of Computer Science and Beckman Institute, University of Illinois at Urbana-Champaign, Urbana, IL, USA, pp. 1-11. Last Accessed, Nov. 11, 2013.
Ozer et al., "A Graph Based Object Description for Information Retrieval in Digital Image and Video Libraries," Dept. of Electrical and Computer Engineering, New Jersey Institute of Technology, Newark, NJ, USA, pp. 1-5. Last Accessed, Nov. 11, 2013.
Pass et al., "Comparing Images Using Color Coherence Vectors," Computer Science Department, Cornell University, Ithaca, NY, USA, ACM Multimedia 96, Boston, MA, USA, 1996, pp. 65-73.
Pentland et al., "Photobook: Content-Based Manipulation of Image Databases," Perceptual Computing Section, The Media Laboratory, Massachusetts Institute of Technology, Cambridge, MA, USA, International Journal of Computer Vision 18(3), 1996, pp. 233-254.
Pentland et al., "View-Based and Modular Eigenspaces for Face Recognition," Perceptual Computing Group, The Media Laboratory, Massachusetts Institute of Technology, Cambridge, MA, USA, 1994 IEEE, pp. 84-91.
Petkovic et al., "Recent applications of IBM's query by image content (QBIC)," SAC '96 Proceeding of the 1996 ACM symposium on Applied Computing, 1996, pp. 2-6.
Pfeiffer et al., "Automatic Audio Content Analysis," University of Mannheim, Mannheim, Germany, ACM Multimedia 96, Boston, MA, USA, 1996, pp. 21-30.
Ratha et al., "A Real-Time Matching System for Large Fingerprint Databases," Department of Computer Science, Michigan State University, MI, USA, IEEE Transactions on Pattern Analysis and Machine Intelligence, vol. 18, No. 8, East Lansing, MI, USA, Aug. 1996, pp. 799-813.
Ravela et al., "Image Retrieval by Appearance," Computer Vision Lab., Multimedia Indexing and Retrieval Group, Center for Intelligent Information Retrieval, University of Massachusetts at Amherst, SIGIR 97 Philadelphia PA, USA, 1997, pp. 278-285.
Rolland et al., "Musical Content-Based Retrieval: an Overview of the Melodiscov Approach and System," ACM Multimedia '99 Oct. 1999, Orlando, FL, USA, pp. 81-84.
Schmid et al., "Combining greyvalue invariants with local constraints for object recognition," GRAVIR, Saint-Martin, 1996 IEEE, pp. 872-877.
Shyu et al., "ASSERT: A Physician-in-the-Loop Content-Based Retrieval System for HRCT Image Databases," School of Electrical and Computer Engineering, Purdue University, West Lafayette, IN, USA, Computer Vision and Image Understanding, vol. 75, Nos. 1/2, Jul./Aug. 1999, pp. 111-132.
Smith et al., "Image Classification and Querying Using Composite Region Templates," IBM T.J. Watson Research Center, Hawthorne, NY, USA, to appear in Journal of Computer Vision and Image Understanding—special issue on Content-Based Access of Image and Video Libraries, pp. 1-36. Last Accessed, Nov. 11, 2013.
Smith et al., "Integrated Spatial and Feature Image Query," IBM T.J. Watson Research Center, Hawthorne, NY, USA, Multimedia Systems 7: (1999), pp. 129-140.
Smith et al., "Quad-Tree Segmentation for Texture-Based Image Query," Center for Telecommunications Research and Electrical Engineering Department, Columbia University, New York, NY, USA, Multimedia 94—0/94 San Francisco, CA, USA, 1994, pp. 279-286.
Smith et al., "Querying by Color Regions using the VisualSEEk Content-Based Visual Query System," Center for Image Technology for New Media and Department of Electrical Engineering, Columbia University, New York, NY, USA, pp. 1-19. Last Accessed, Nov. 11, 2013.
Smith et al., "Single Color Extraction and Image Query," Columbia University, Center for Telecommunications Research, Image and Advanced Television Laboratory, New York, NY, USA (to appear at the International Conference on Image Processing (ICIP-95), Washington, DC, Oct. 1995), pp. 1-4.
Smith et al., "VisualSEEk: a fully automated content-based image query system," Department of Electrical Engineering and Center for Image Technology for New Media, Columbia University, New York, NY, USA, ACM Multimedia 96, Boston, MA, USA, pp. 87-98. Last Accessed, Nov. 11, 2013.
Subromanya et al., "Use of Transforms for Indexing in Audio Databases," Department of Computer Science, University of Missouri-Rolla, Rolla, MO, USA, pp. 1-7. Last Accessed, Nov. 11, 2013.
Swanson et al., "Robust audio watermarking using perceptual masking," Department of Electrical Engineering, University of Minnesota, Minneapolis, MN, USA, Signal Processing 66 (1998), pp. 337-355.
Toivonen et al., "Discovery of Frequent Patterns in Large Data Collections," Department of Computer Science, Series of Publications A, Report A—May 1996, University of Helsinki, Finland, pp. 1-127.
Torres et al., "User modelling and adaptivity in visual information retrieval systems," Distributed Multimedia Research Group, Computing Dept., Lancaster University, USA, pp. 1-6. Last Accessed, Nov. 11, 2013.
Uchida et al., "Fingerprint Card Classification with Statistical Feature Integration," Fourteenth International Conference on Pattern

(56) References Cited

OTHER PUBLICATIONS

Recognition, C&C Media Laboratories, NEC Corporation, Kawasaki, Japan, Aug. 16-20, 1998, pp. 1-42.
Uitdenbogerd et al., "Manipulation of Music for Melody Matching," Department of Computer Science, RMIT, Melbourne, Victoria, Australia, ACM Multimedia 1998, Bristol, UK, pp. 235-240.
Uitdenbogerd et al., "Melodic Matching Techniques for Large Music Databases," Department of Computer Science, RMIT University, Melbourne, Australia, ACM Multimedia 1999, Orlando, FL, USA, pp. 57-66.
Veltkamp et al., "Content-Based Image Retrieval Systems: A Survey," Department of Computing Science, Utrecht University, Oct. 28, 2002, Revised and extended version of Technical Report UU-CS-2000-34, Oct. 2000, pp. 1-62.
Wactlar et al., "Intelligent Access to Digital Video: Informedia Project," Carnegie Mellon University, 1996 IEEE, pp. 46-52.
Wang et al., "Content-based Image Indexing and Searching Using Daubechies' Wavelets," Department of Computer Science and School of Medicine, Stanford University, Stanford, CA, USA, pp. 1-10. Last Accessed, Nov. 11, 2013.
Wang et al., "Wavelet-Based Image Indexing Techniques with Partial Sketch Retrieval Capability," Stanford University, Stanford, CA, USA, Proceedings of the Fourth Forum on Research and Technology Advances in Digital Libraries, 1997, pp. 1-12.
Wold et al., "Classification, Search, and Retrieval of Audio," Muscle Fish LLC, Berkeley, CA, USA, CRC Handbook of Multimedia Computing 1999, pp. 1-19.
Wold et al., "Content-Based Classification, Search, and Retrieval of Audio," Muscle Fish, 1996 IEEE, pp. 27-36.
Yang et al., "A Study on Retrospective and On-Line Event Detection," School of Computer Science, Carnegie Mellon University, Pittsburgh, PA, USA, SIGIR '98, Melbourne, Australia,1998 ACM, pp. 28-36.
Yoshitaka et al., "A Survey on Content-Based Retrieval for Multimedia Databases," Faculty of Engineering, Hiroshima University, Hiroshima, Japan, IEEE Transactions on Knowledge and Data Engineering, vol. 11, No. 1, Jan./Feb. 1999, pp. 81-93.
International Searching Authority, "Search Report", issued in connection with International Application No. PCT/US12/047245, mailed Oct. 5, 2012, 2 pages.

* cited by examiner

BONUS AND EXPERIENCE ENHANCEMENT SYSTEM FOR RECEIVERS OF BROADCAST MEDIA

RELATED APPLICATIONS

This application claims priority under 35 U.S.C. §119(e) to U.S. Provisional Application No. 61/331,195 entitled "BONUS AND EXPERIENCE ENHANCEMENT SYSTEM FOR RECEIVERS OF BROADCAST MEDIA", filed on May 4, 2010, U.S. Provisional Application No. 61/332,587 entitled "AUTOMATIC DETECTION OF BROADCAST PROGRAMMING", filed on May 7, 2010, U.S. Provisional Application No. 61/347,737 entitled "AUTOMATIC GROUPING FOR USERS EXPERIENCING A SPECIFIC BROADCAST MEDIA", filed on May 24, 2010, and U.S. Provisional Application No. 61/360,840 entitled "SYSTEM FOR PROVIDING SERVICES TO A USER ASSOCIATED WITH A BROADCAST TELEVISION OR RADIO SHOW BEING EXPERIENCED BY THE USER", filed on Jul. 1, 2010, each of which is incorporated by reference herein in its entirety.

BACKGROUND OF THE DISCLOSURE

1. Field of the Invention

Aspects of the present invention relate to a system and method for interacting with broadcast media.

2. Discussion of Related Art

Consumers of broadcast media (e.g., radio and television broadcasts) typically receive broadcast media passively through a receiver (e.g., a radio or television). For example, an individual listening to a radio or watching a television may listen to and/or watch broadcast media signals passively received by the radio or television over a selected channel. Despite various advancements in broadcasting equipment, current systems are generally not interactive with respect to the media being broadcast.

SUMMARY

According to one aspect of the present invention, it is appreciated that in traditional broadcasting systems, individuals are unable to interact with the received broadcast media. Alternatively, with internet enabled devices (e.g., computers, cell phones, laptops, etc.), a user may be able to specifically select desired media content which the user wishes to view (rather than merely a desired channel) and may also directly interact with selected media content via the internet enabled device. However, a problem exists whereby even though both broadcast media receivers and internet enabled devices are commonly utilized today, individual broadcast media receivers and internet enabled devices are not directly linked to allow for interaction between the receivers and devices to provide the user with benefits of both types of systems.

Also, in addition to users not being able to directly interact with the broadcast media, television and radio broadcast providers are also typically unable to directly interact with the users. For example, in conventional broadcast media reward-based systems, a user is typically rewarded for taking a specific defined action (e.g., logging in or "checking in"). However, in such systems, there is no way for the broadcast provider to confirm that the user is actually viewing or listening to the required program. The broadcast provider must take the word of the user. In addition, in such systems, the user must take an additional intermediary step (e.g., "checking-in") to be rewarded. In this way, merely viewing or listening to a program is not typically enough to receive rewards.

In another example, in conventional broadcast media related chat groups, it is a common problem that a chat group may become overcrowded because of the large number of people who view broadcast programming and wish to discuss it with others. For instance, too many users who are viewing the same program may be in the same chat room, making meaningful discussion difficult. For example, due to a large number of posters, a post of a single user may not remain visible long enough for it to be read in detail.

According to one aspect the present invention features a method for awarding incentives, the method comprising receiving, via a first interface of a server, audio signals from a user over a communication network, receiving, via a second interface of the server, audio signals from a plurality of broadcast channels over the communication network, comparing, by a processor in the server, the audio signals received from the user and the audio signals received from the plurality of broadcast channels, determining, by the processor, based on the act of comparing, that the audio signals from the user correspond to a program currently being broadcast on one of the plurality of broadcast channels, and in response to the act of determining, automatically awarding, by the processor, the user at least one incentive.

According to one embodiment, the method further comprises tracking, based on the act of determining, a program history of the user. In one embodiment, the method further comprises generating, based on the act of tracking, a program history profile corresponding to the user. In another embodiment, the act of awarding further comprises awarding incentives to the user based on the user's program history profile.

According to another embodiment, the method further comprises awarding, by the processor, bonus incentives to the user in response to the user interacting with the program currently being broadcast. In one embodiment, the act of awarding bonus incentives includes awarding bonus incentives to the user in response to the user participating in a chat related to the program currently being broadcast. In another embodiment, the act of awarding bonus incentives includes awarding bonus incentives to the user in response to the user making a comment in a social media network related to the program currently being broadcast. In one embodiment, the act of awarding bonus incentives includes awarding bonus incentives to the user in response to the user participating in a poll related to the program currently being broadcast.

According to another aspect, the present invention features a system for awarding incentives, the system comprising a server comprising, a first interface configured to be coupled to a communication network and to receive audio signals from a user over the communication network, a second interface configured to be coupled to the communication network and to receive audio signals from a plurality of broadcast channels over the communication network, and a processor coupled to the first interface and the second interface, wherein the processor is configured to associate the audio signals from the user with a program currently being broadcast on one of the plurality of broadcast channels and in response, automatically award at least one incentive to the user.

According to one embodiment, the at least one incentive is at least one reward point capable of being redeemed by the user towards an award. In another embodiment, the processor is further configured to automatically track an amount of time that the first interface is receiving audio signals from the user associated with the program currently being broadcast and to automatically award a corresponding incentive to the user in response to the amount of time. In one embodiment, the processor is further configured to award at least one incentive to the user in response to the user interacting with the program currently being broadcast.

According to one embodiment, the system further comprises a data storage coupled to the processor, the data storage configured to maintain a database including a profile associated with the user, wherein the profile includes a program history associated with the user. In one embodiment, the profile also includes incentive information related to the user.

According to one aspect, the present invention features a computer readable medium comprising computer-executable instructions that when executed on a processor performs a method for awarding incentives, the method comprising acts of receiving, via a first interface of a server, audio signals from a user over a communication network, receiving, via a second interface of the server, audio signals from a plurality of broadcast channels over the communication network, comparing, by a processor in the server, the audio signals received from the user and the audio signals received from the plurality of broadcast channels, determining, by the processor, based on the act of comparing, that the audio signals from the user correspond to a program currently being broadcast on one of the plurality of broadcast channels, and in response to the act of determining, automatically awarding, by the processor, the user at least one incentive.

According to one embodiment, the method further comprises tracking, based on the act of determining, a program history of the user. In another embodiment, the method further comprises generating, based on the act of tracking, a program history profile corresponding to the user. In one embodiment, the act of awarding further comprises awarding incentives to the user based on the user's program history profile.

According to another embodiment, the method further comprises awarding bonus incentives to the user in response to the user interacting with the program currently being broadcast. In one embodiment, the act of awarding bonus incentives includes awarding bonus incentives to the user in response to an amount time that the first interface is receiving audio signals from the user corresponding to the program currently being broadcast.

According to another aspect, the present invention features a method for the detection of broadcast programming, the method comprising acts of receiving, via a first interface of a server, audio signals from a user over a communication network, receiving, via a second interface of the server, audio signals from a plurality of broadcast channels over the communication network, comparing, by a processor in the server, the audio signals from the user with the audio signals from the plurality of broadcast channels, determining by the processor, in response to the act of comparing, that the audio signals from the user match the audio signals from at least one of the plurality of broadcast channels, identifying by the processor, in response to the act of determining, the at least one of the plurality of broadcast channels, and transmitting by the processor, in response to the act of identifying, information related to the at least one of the plurality of broadcast channels to the user.

According to one embodiment, the act of receiving audio signals from the user includes an act of receiving audio signals from a computer system associated with the user, the computer system being located proximate a receiver of the at least one of the plurality of broadcast channels.

According to another embodiment, the act of comparing includes an act of comparing the audio signals from the user with the audio signals from the plurality of broadcast channels using a comparison technique selected from a group comprising signal cross-correlation, fingerprinting, thumbprinting, and hashing.

According to one embodiment, the acts of comparing, determining and identifying are performed automatically in response to the act of receiving audio signals from the user. In one embodiment, the acts of comparing, determining and identifying are performed absent an intermediary action by the user.

According to another embodiment, the method further comprises acts of receiving, by the processor, schedule information related to the at least one of the plurality of broadcast channels, and identifying by the processor, in response to the act of receiving schedule information, a program corresponding to the audio signals received from the user.

According to one embodiment, the method further comprises an act of providing, by the processor, program specific content to the user in response to the act of identifying. In one embodiment, the act of providing program specific content includes providing an interface that includes information corresponding to the program, the information selected from a group comprising a poll, a chat group, and incentive information.

According to another embodiment, the method further comprises acts of tracking by the processor, based on the act of identifying a program, a program history of the user, and generating by the processor, based on the act of tracking, a program history profile corresponding to the user. In one embodiment, the method further comprises an act of providing, by the processor, program specific content to the user based on the program history profile.

According to another aspect, the present invention features a system for the detection of broadcast programming, the system comprising a server comprising a first interface configured to be coupled to a communication network and to receive audio signals from a user over the communication network, a second interface configured to be coupled to the communication network and to receive audio signals from a plurality of broadcast channels over the communication network, and a processor coupled to the first interface and the second interface, wherein the processor is configured to match the audio signals received from the user with the audio signals received from at least one of the plurality of broadcast channels, identify the at least one of the plurality of broadcast channels, and transmit identification information related to the at least one of the plurality of broadcast channels to the user.

According to one embodiment, the processor is further configured to automatically match the audio signals received from the user with the audio signals received from the at least one of the plurality of broadcast channels in response to receiving audio signals from the user. In one embodiment, the processor is further configured to automatically identify the at least one of the plurality of broadcast channels absent an intermediary action by the user.

According to another embodiment, the processor is further configured to be coupled to a schedule module and to receive schedule information from the schedule module related to the at least one of the plurality of broadcast channels and in response, identify a program corresponding to the audio signals received from the user. In one embodiment, the processor is further configured to provide program specific content to the user in response to identifying the program.

According to one embodiment, the processor is further configured to provide a chat interface to the user that corresponds to the program. In one embodiment, the processor is further configured to be coupled to a reward engine and to provide an incentive to the user that corresponds to the program. In another embodiment, the processor is further configured to be coupled to a recommendation engine and to provide recommended content to the user that corresponds to the program.

According to one aspect, the present invention features a computer readable medium comprising computer-executable instructions that when executed on a processor performs a method for the detection of broadcast programming, the method comprising acts of receiving, via a first interface of a server, audio signals from a user over a communication network, receiving, via a second interface of the server, audio signals from a plurality of broadcast channels over the communication network, comparing, by a processor in the server, the audio signals from the user with the audio signals from the plurality of broadcast channels, determining by the processor, in response to the act of comparing, that the audio signals from the user match the audio signals from at least one of the plurality of broadcast channels, identifying by the processor, in response to the act of determining, the at least one of the plurality of broadcast channels, and transmitting by the processor, in response to the act of identifying, information related to the at least one of the plurality of broadcast channels to the user.

According to one embodiment, the acts of comparing, determining and identifying are performed automatically in response to the act of receiving audio signals from the user. In one embodiment, the method further comprises acts of, receiving, by the processor, schedule information related to the at least one of the plurality of broadcast channels, and identifying by the processor, in response to the act of receiving schedule information, a program corresponding to the audio signals received from the user. In another embodiment, the method further comprises an act of providing, by the processor, program specific content to the user in response to the act of identifying a program.

According to another aspect, the present invention features a method for grouping chat users, the method comprising acts of receiving, via a first interface of a server, audio signals from a user over a communication network, receiving, via a second interface of the server, audio signals from a plurality of broadcast channels over the communication network, comparing, by a processor in the server, the audio signals received from the user and the audio signals received from the plurality of broadcast channels, determining, by the processor, based on the act of comparing, that the audio signals from the user correspond to a program currently being broadcast on one of the plurality of broadcast channels, and grouping, by the processor, the user into a chat group based on at least one grouping criteria, the at least one grouping criteria including the program currently being broadcast.

According to one embodiment, the method further comprises an act of determining, by the processor, a location of the user, wherein the at least one grouping criteria includes the location of the user. In another embodiment, the method further comprises an act of extracting social media information from a social media network account of the user, wherein the at least one grouping criteria includes the social media information. In one embodiment, the act of grouping is performed automatically in response to the act of receiving audio signals from the user.

According to another embodiment, the method further comprises an act of tracking by the processor, based on the act of determining, a program history of the user. In one embodiment, the method further comprises an act of generating by the processor, based on the act of tracking, a program history profile corresponding to the user. In another embodiment, the at least one grouping criteria includes information extracted from the program history profile.

According to one embodiment, the at least one grouping criteria includes size of the chat group. In one embodiment, the method further comprises an act of determining the size of the chat group to maintain a desired time limit between comments within the chat group.

According to one aspect, the present invention features a system for grouping chat users, the system comprising a server comprising a first interface coupled to a communication network and configured to receive audio signals from a user over the communication network, a second interface coupled to the communication network and configured to receive audio signals from a plurality of broadcast channels over the communication network, and a processor coupled to the first interface and the second interface, wherein the processor is configured to associate the audio signals from the user with a program currently being broadcast on one of the plurality of broadcast channels, and group the user into a chat group based on a grouping framework stored in the processor, the grouping framework including the program currently being broadcast.

According to one embodiment, the processor is configured to be coupled to an internet enabled device having an IP address, and to determine a location of the user based on the IP address, and wherein the grouping framework includes the location of the user. In one embodiment, the processor is configured to be coupled to a social media network, and to extract a friend network from a social media network account of the user, and wherein the grouping framework includes the social media information. In another embodiment, the processor is configured to group the user into the chat group automatically in response to receiving audio signals from the user.

According to another embodiment, the processor is further configured to track a program history of the user. In one embodiment, the processor is further configured to generate a program history profile corresponding to the user.

According to one embodiment, the grouping framework includes information extracted from the program history profile. In one embodiment, the grouping framework includes size of the chat group.

According to another aspect, the present invention features a computer readable medium comprising computer-executable instructions that when executed on a processor performs a method for grouping chat users, the method comprising acts of receiving, via a first interface of a server, audio signals from a user over a communication network, receiving, via a second interface of the server, audio signals from a plurality of broadcast channels over the communication network, comparing, by a processor, the audio signals received from the user and the audio signals received from the plurality of broadcast channels, determining, by the processor, based on the act of comparing, that the audio signals from the user correspond to a program currently being broadcast on one of the plurality of broadcast channels, and grouping, by the processor, the user into a chat group based on at least one grouping criteria, the at least one grouping criteria including the program currently being broadcast.

According to one embodiment, the act of grouping includes an act of grouping the user into a chat group based on at least one grouping criteria selected from a group comprising a location of the user, social media information related to the user, a viewing history of the user and size of the chat group. In another embodiment, the act of grouping is performed automatically in response to the act of receiving audio signals from the user.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION

Figure 1:
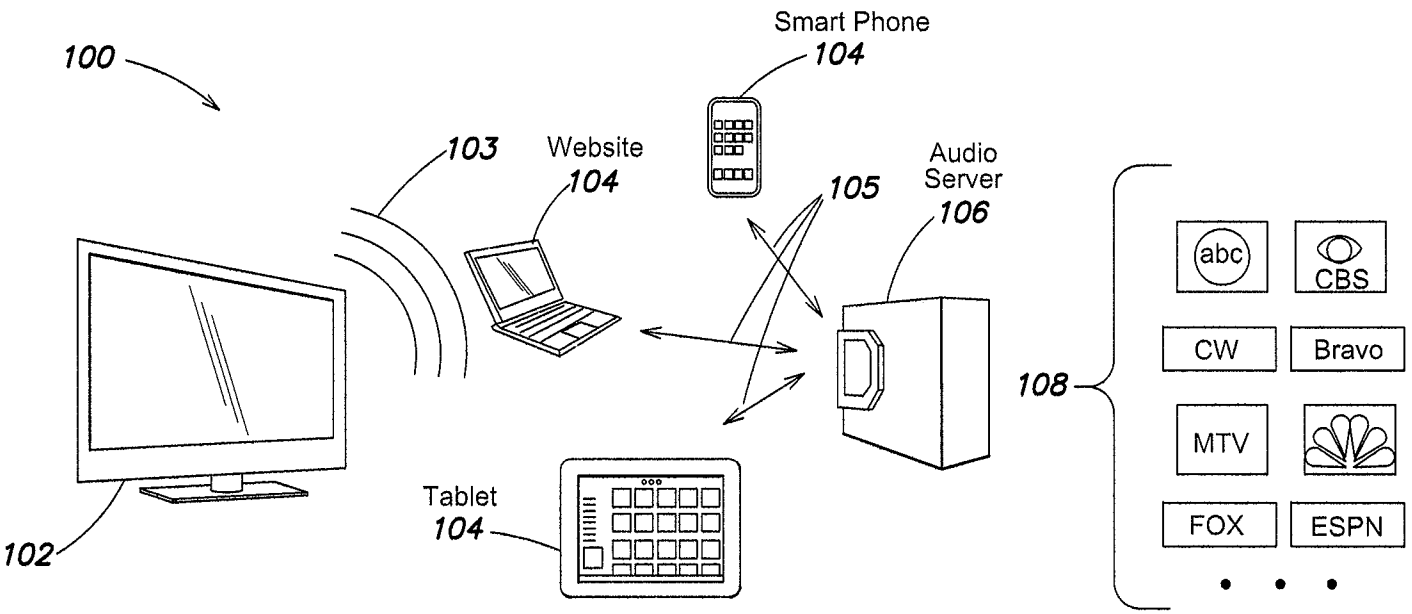
FIG. 1 is a block diagram of a television audio synchronization system in accordance with one embodiment of the present invention.

Embodiments of the invention are not limited to the details of construction and the arrangement of components set forth in the following description or illustrated in the drawings. Embodiments of the invention are capable of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

As described above, individual broadcast media receivers and internet enabled devices are not directly linked. As a result, users are unable to directly interact with received broadcast media. Common applications may allow for a user to indirectly interact with received broadcast media; however, such applications require an intermediary action by a user of the broadcast media receiver and internet enabled device. For example, while viewing or listening to broadcast media via a broadcast media receiver, a typical application on an internet enabled device (e.g., a cell phone or computer) may allow a user to log in and identify (i.e. "checking-in") what broadcast media they are currently viewing or listening to. In response to the identification provided by the user, the application may provide additional options, such as allowing the user to chat with other people viewing or listening to the same broadcast media, providing the user an opportunity to vote in a poll related to the broadcast media, or allowing the user to gain bonus, experience or reward points for "checking in" and/or participating in a poll.

However, in requiring the user of the broadcast media receiver and internet enabled device to take the extra intermediary step of "checking in", the broadcast media receiver and the internet enabled device are not directly linked. Thus, the information provided by the user to the internet enabled device may not be entirely accurate. For example, after a user has already "checked in" in relation to a certain program; a user may begin viewing or listening to a different program (e.g., by turning the channel of the broadcast media receiver). If the user fails to update the application on the internet enabled device to reflect the new program, the application on the internet enabled device will still think the user is watching or listening to the old program and will continue to provide information related to that program. Also, if reward points are being offered by the application for viewing a specific program, a dishonest user may "check-in" to a program they are not actually viewing or listening to in an effort to gain the reward points. Because of the indirect nature of the connection between the broadcast media receiver and the internet enabled device, there is no way for the application on the internet enabled device to confirm that the user is actually watching or listening to the reward giving program.

Also, in addition to users not being able to directly interact with the broadcast media, television and radio broadcasters are unable to directly interact with the users. Traditionally, television and radio broadcasters have a uni-directional relationship with their viewers. For example, while broadcasting television or radio signals to a user, television and radio broadcasters are unable to directly track how many people are watching/listening to their broadcast media. As such, television and radio broadcasters typically rely on diaries and surveys to determine how many people are watching/listening to their programming. However, diaries and surveys suffer from a number of problems. For example, diaries and surveys are not able to offer real time feedback and are only as reliable as a consumer's memory. An alternative may be the use of a set meter for measuring viewer or listener behavior. However, despite being more accurate than the diaries and surveys, the set meters still do not offer real-time feedback and typically report overall viewing for a period of time (e.g., a 24 hour period of time).

As such, the current invention provides a system and method for automatically detecting and identifying, with an internet enabled device, broadcast media being viewed or listened to by a user and for allowing the user to directly interact with the received broadcast media via the internet enabled device.

One example of a system 100 for automatically detecting and identifying broadcast media in accordance with aspects of the current invention is shown in FIG. 1. The system 100 includes a broadcast media receiver 102. The broadcast media receiver 102 is coupled to a broadcast media network through a wired or wireless connection and is configured to receive broadcast media signals from the broadcast media network. As shown in FIG. 1, the broadcast media receiver 102 is a television. However, according to other embodiments, the broadcast media receiver 102 may be any device capable of receiving broadcast media signals (e.g., a radio, a digital cable television receiver, an analog cable television receiver, a satellite television receiver etc.).

The system 100 also includes an internet enabled device 104. As shown in FIG. 1, an internet enabled device 104 may include a mobile phone (e.g., a smart phone) or a computer (e.g., a laptop computer, personal computer or tablet computer). According to other embodiments, the internet enabled device 104 may be any internet capable device that includes a microphone. The internet enabled device 104 is located proximate the broadcast media receiver 102 to receive audio signals 103 projected by the broadcast media receiver 102 in response to broadcast media signals received over the broadcast media network. The internet enabled device 104 is also coupled to an external network 105 (e.g., the internet) via a wired or wireless connection.

The system 100 also includes a matching server 106. The matching server 106 is also coupled to the external network 105, via a wired or wired connection, and is configured to communicate with an internet enabled device 104 over the external network. From the external network 105, the matching server 106 receives audio streams of the audio signals received by the internet enabled device 104, via a first interface, and also audio streams 108 of broadcast media from one or more known broadcast channels (e.g., known radio or television stations), via a second interface.

The matching server 106 compares the audio stream from the internet enabled device 104 with audio streams from the known broadcast channels, matches the audio stream from the internet enabled device 104 with audio streams 108 from the known broadcast channels and automatically identifies the broadcast media that the user is viewing or listening too. Based on this matching, the server 106 provides to the user, via the internet enabled device 104, one or more features and/or functionality that correspond to the detected broadcast, allowing the user to directly interact with the detected broadcast. The interaction between the internet enabled device 104 and the matching server 106 will now be described in greater detail with relation to FIG. 2.

Figure 2:
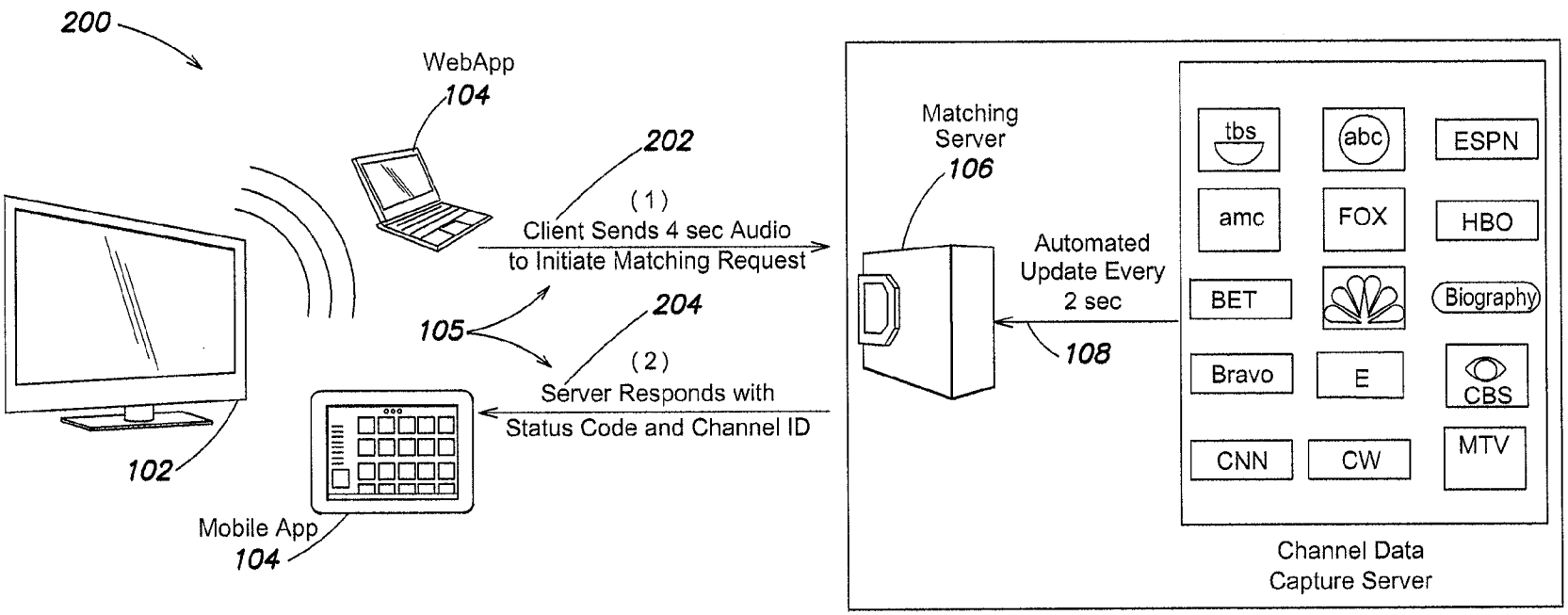
FIG. 2 is a block diagram illustrating an Application Programming Interface (API) in accordance with one embodiment of the present invention.

FIG. 2 illustrates a block diagram of an Application Programming Interface (API) 200 between an internet enabled device 104 and the matching server 106. As discussed above, the internet enabled device 104 and the matching server 106 are coupled via an external network 105. Upon receiving audio signals from the broadcast media receiver 102 via its microphone, the internet enabled device 104 transmits matching requests 202, including the audio signals, via the external network 105, to the matching server 106. According to one embodiment, the matching requests 202 are sent in four to five second bursts, every fifteen seconds. However, according to other embodiments, the duration of matching requests and time between matching requests may be defined as any amount of time.

According to one embodiment, communication between the internet enabled device 104 and the matching server 106 (e.g., a matching request 202) may include a variety of parameters. Certain parameters may be defined as optional or required. Such parameters may include:

- auth_token—An authorization token that is issued by the matching server 106 to identify the client application on the internet enabled device 104. Matching requests 202 without valid auth_token may be refused.
- action—Contains action requested by the client via the internet enabled device. For example, actions may include:
  - MATCH—Begins a new matching request for audio stream received by internet enabled device 104
  - INFO—Returns information on status of matching server 106
  - CONFIG—Returns information on client parameters required to perform matching action
- session_id—A session parameter identifying the client user of the internet enabled device 104.
- client_version—A version string to identify the version of the application operated by the client.

In addition to the parameters discussed above, matching requests 202 sent by the internet enabled device 104 also include audio signals received by the internet enabled device 104 from the broadcast media receiver 102. According to one embodiment, the audio signals are sent with the MATCH action; however, the transfer of audio data between the internet enabled device 104 and the matching server 106 may be configured differently. According to one embodiment, the format and encoding of the audio signals sent by the internet enabled device 104 to the matching server 106 is determined based on at least one of the parameters discussed above. For example, according to one embodiment, the format and encoding of the audio signals is based on the client_version identifier. According to one embodiment, the audio signals are formatted and encoded as 16 Bit, 22 KHz, mono, Speex signals. However, according to other embodiments, the audio signals may be formatted and encoded in any way.

The matching server 106 also constantly receives audio channel feeds 108 from known broadcast media channels. According to one embodiment, the matching server 106 captures information from the known broadcast media channels every two seconds. However, according to other embodiments, the matching server 106 may be configured to capture information from the known broadcast media channels at any desired interval. According to one embodiment, in addition to receiving broadcast media feeds from known channels, the matching server 106 also receives schedule information related to the received broadcast media from the known channels.

According to one embodiment, the matching server 106 is configured to capture information from location specific broadcast media channels. For example, broadcast media networks typically have separate feeds for western and eastern time zones (customers in the eastern and central time zones receive the east coast feed and customers in the pacific and mountain time zones receive the west coast feed). According to one embodiment, a matching server 106 may be configured to receive the east coast feed, the west coast feed, or both feeds.

According to one embodiment, an internet enabled device 104 determines the location (e.g., the time zone) of a user based on the IP address of the internet enabled device 104. Based on the determined location of the user, the internet enabled device 104 will communicate with an appropriate location specific matching server 106. For example, according to one embodiment, based on a determination by the internet enabled device 104 that a user is in the eastern or central time zone, the internet enabled device 104 will send a matching request to a matching server 106 receiving east coast feeds. Alternatively, based on a determination by the internet enabled device 104 that a user is in the western or mountain time zone, the internet enabled device 104 will send a matching request to a matching server 106 receiving west coast feeds.

Figure 3:
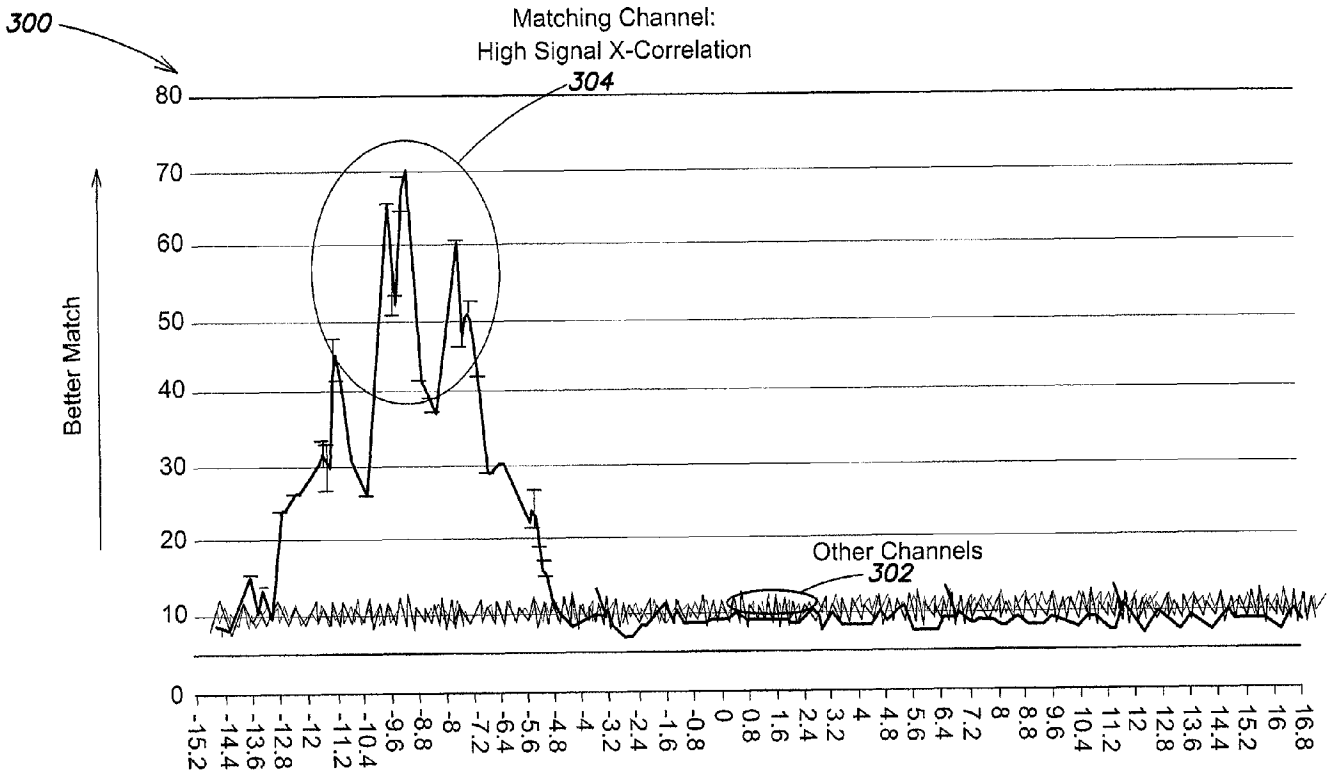
FIG. 3 is a graph illustrating signal cross-correlation in accordance with one embodiment of the present invention.

Based on the received audio feeds from the internet enable devices 104 and the known broadcast media channels, the matching server 106 calculates signal cross-correlation (X-Correlation) between the audio signals 202 received from the internet enabled device 104 and the audio signals 108 received from the known broadcast channels to determine whether any matching exists between the signals. An example of X-Correlation 300 between signals is illustrated in FIG. 3. Audio signals 108 from the known broadcast channels are compared to the audio signals 202 received from the internet enabled device. As shown in FIG. 3, signals 302 that do no match will result in low signal X-Correlation. However, if an audio signal 304 from a known broadcast channel does match audio signals 202 from the internet enabled device 104, then a high signal X-Correlation will result. Upon detecting a high signal X-Correlation with a known broadcast channel, the matching server 106 determines that the audio signals being received by the internet enabled device 104 match the program being broadcast by the known broadcast channel.

According to one embodiment, the matching server 106 compares audio signals 202 from the internet enabled device 104 to the audio signals 108 from the known broadcast channels over a sliding period of time or window. According to one embodiment, the window is a thirty second window. However, in other embodiments, the window may be defined as having any length. By comparing signals over a sliding window, the matching server 106 is able to account for signal delays between the audio signals 202, 108. For example, if broadcast signals received by an internet enabled device 104 are transmitted via a satellite system, there will likely be a delay between when the signals are actually broadcast over the known channel to when they are received by the internet enabled device 104. Therefore, by matching signals within a window, the matching server 106 accounts for the potential delay.

Upon performing matching, the matching server 106 responds to the matching request 202 of the internet enabled device 104. According to one embodiment, a response 204 to the matching request by the matching server 106 is sent within ten seconds of receiving the matching request. However, according to other embodiments, a response 204 to a matching request may be configured to be sent at any time upon receiving a matching request 202.

According to one embodiment, a response 204 to a matching request 202 may include a variety of parameters. Certain parameters may be defined as optional or required. Such parameters may include:

- result_status—The outcome of the matching operation includes one of the following identifiers:
  - SUCCESS—Successful matching operation
  - NOMATCH—Matching operation did not yield successful result
  - ERROR—An error (e.g., invalid audio format provided) prevented a successful operation. Check status_msg for details.
- status_code—Status code capable of indicating status of matching operation (e.g., an error).
- status_msg—Status message capable of displaying reason for error
- channel_id—The unique identifier of the recognized (matched) channel
- channel_shortname—Official short name of the recognized channel
- channel_longname—Official long name of the recognized channel.

According to one embodiment, using at least one of the parameters identified above, the matching server 106 may also retrieve information about the specific matched program being viewed or listened to on the matched channel. For example, in one embodiment, the channel_id parameter may be used by the matching server 106 to retrieve schedule and/or program information from an Electronic Program Guide (EPG) about the matched program currently being broadcast on the matched channel. According to one embodiment, the matching server 106 retrieves information from the EPG such as the name and synopsis of the matched program. According to other embodiments, the matching server 106 also retrieves meta-information from the EPG including the cast, producer, genre, rating, etc. of the matched program. According to other embodiments, any type of information related to the matched program may be retrieved by the matching server 106.

Upon completing the matching operation and retrieving information related to the matched channel and matched program, the matching server 106 transmits the matching program and matching channel information back to the user via the internet enabled device 104. According to one embodiment, the internet enabled device 104 includes a reference client application to illustrate the information provided by the matching server 106. In one embodiment, the reference client application is implemented in ActionScript; however, in other embodiments, the reference client application may be implemented in any other appropriate programming language.

According to one embodiment, the reference client displays information related to the matched channel and/or program. For example, in one embodiment, the reference client displays at least one of the network name of the matched channel, the name of the matched program, or a synopsis of the matched program. In other embodiments, the reference client displays other information related to the matched program such as the cast, producer, genre, rating etc. In one embodiment, the reference client displays other information related to the matched channel and/or program, such as related advertising or social media functionality. Additional functionality displayed by the reference client in response to a matched channel or program will be discussed in greater detail below.

Figure 4:
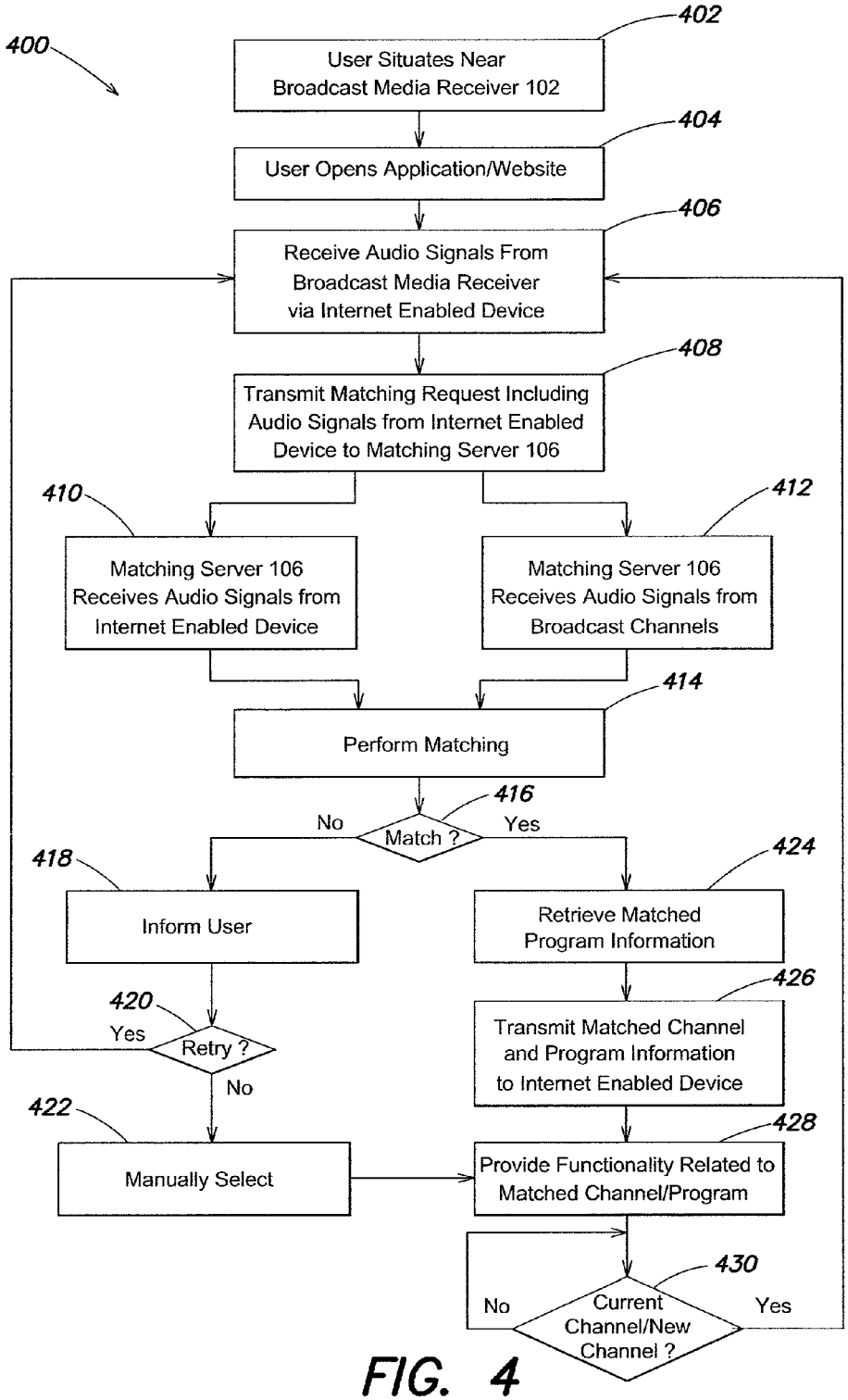
FIG. 4 is a flow chart of a process for the automatic detection of broadcast programming in accordance with one embodiment of the present invention.

The operation of the system 100 will now be described in greater detail in relation to FIG. 4. FIG. 4 is a flow chart 400 of a process for the automatic detection of broadcast programming in accordance with one embodiment of the present invention. At block 402, a user of an internet enabled device 104 situates himself near a broadcast media receiver 102 (e.g., an audio source such as a television or radio receiving broadcast media signals).

At block 404, the user operates the internet enabled device 104 to open an application and/or website configured to communicate with a matching server 106. At block 406, the internet enabled device 104 receives audio signals from the broadcast media receiver 102 via a microphone.

At block 408, the internet enabled device 104 transmits the audio signals received from the broadcast media receiver 102 to the matching server 106. According to one embodiment, the audio signals may be transmitted by the internet enabled device 104 to the matching server 106 in sequences of a few seconds via real time streaming. For example, as discussed above, matching requests 202 including the audio signals may be sent in four to five second bursts, every fifteen seconds. However, according to other embodiments, the duration of matching requests and time between matching requests may be defined as any amount of time.

At block 410, the matching server 106 receives the audio signals transmitted by the internet enabled device 104 and stores the audio signals at least temporarily for processing. At block 412, at the same time as the matching server 106 is receiving audio signals from the internet enabled device 104, the matching server 106 is also receiving and storing live audio signals from a plurality of known broadcast channels (e.g., a plurality of known television and/or radio channels).

According to one embodiment, the matching server 106 only stores, at any given moment, a small portion of the audio signals from the internet enabled device 104 and the audio signals from the known broadcast channels. For example, according to one embodiment, the matching server 106 receives a few seconds of audio data, processes the audio data and deletes the few seconds of audio data, before repeating the process again and again over time as the matching process is performed. However, in other embodiments, the matching server 106 may store received audio data for longer periods of time.

At block 414, the matching server 106 compares the audio signals received from the internet enabled device 104 with the audio signals received from the known broadcast channels. According to one embodiment, as described above, matching is performed using signal cross-correlation. However, in other embodiments, matching may be performed using any comparison technique including other types of correlation, fingerprinting, thumb printing, hashing or any other appropriate matching technique.

At block 416, the matching server 106 makes a determination (e.g., based on the matching process results), whether the audio signals received from the internet enabled device 104 match any one of the audio streams from the known broadcast channels. At block 418 in response to a determination that there was no successful match; the user of the internet enabled device 104 is informed of the matching process failure. At block 420, the user is queried whether they would like to attempt the matching process again. In response to a determination by the user that the matching process should be performed again, the process begins again at block 406.

At block 422, in response to a determination by the user that the matching process should not be performed again, the user is able to manually select the program that they are currently viewing or listening to. According to one embodiment, a list of programs currently broadcasting on known broadcast channels may be retrieved by the internet enabled device 104 from the EPG via the matching server 106.

At block 424, in response to a successful matching operation where a matching channel is identified by the matching server 106, the matching server 106 retrieves information about the currently being viewed matched program, via the EPG. For example, as discussed above, the matching server 106 may retrieve schedule information, the program title, the program synopsis, the cast, the producer, the genre, the rating etc. . . . of the matched program.

At block 426, the matching server 106 transmits the information related to the matched channel and program to the user via the internet enabled device 104. As discussed above, according to one embodiment, such information may be displayed via a reference client.

At block 428, in response to the currently viewed or listened to program being automatically matched or manually selected, the matching server may provide additional functionality related to the current program to the user via the internet enabled device. Such additional functionality may include advertisements, targeted programming, chat, games, EPG, links, software etc. The additional functionality provided in response to identifying a currently being viewed program will be discussed in greater detail below.

According to one embodiment, at block 430 the matching server 106 determines whether the user has changed the currently being viewed/listened to program. According to one embodiment, the matching server 106 determines whether the program has changed by continuing to receive audio signals from the internet enabled device 104 and comparing the audio signals to the currently matched channel. According one embodiment, the matching server 106 is configured to check, at defined intervals, whether the current program has changed. In one embodiment, the defined intervals are predefined. In another embodiment, the defined intervals are variable at the election of the user or an administrator of the matching server 106.

If no change in program is detected, the matching server 106 continues to monitor the audio signals from the internet enabled device 104 for a change in programming. If a change in program is detected, the audio matching process is started again from block 406.

As described above, upon the automatic identification of a channel and a program currently being viewed by a user, functionality related to the identified channel and/or program is provided to the user via the internet enabled device 104. According to one embodiment, specific functionality related to the identified channel and/or program is automatically presented to the user via the internet enabled device 104. According to another embodiment, specific functionality related to the identified channel and/or program may be presented to the user, via the internet enabled device 104, as available options.

Figure 5:
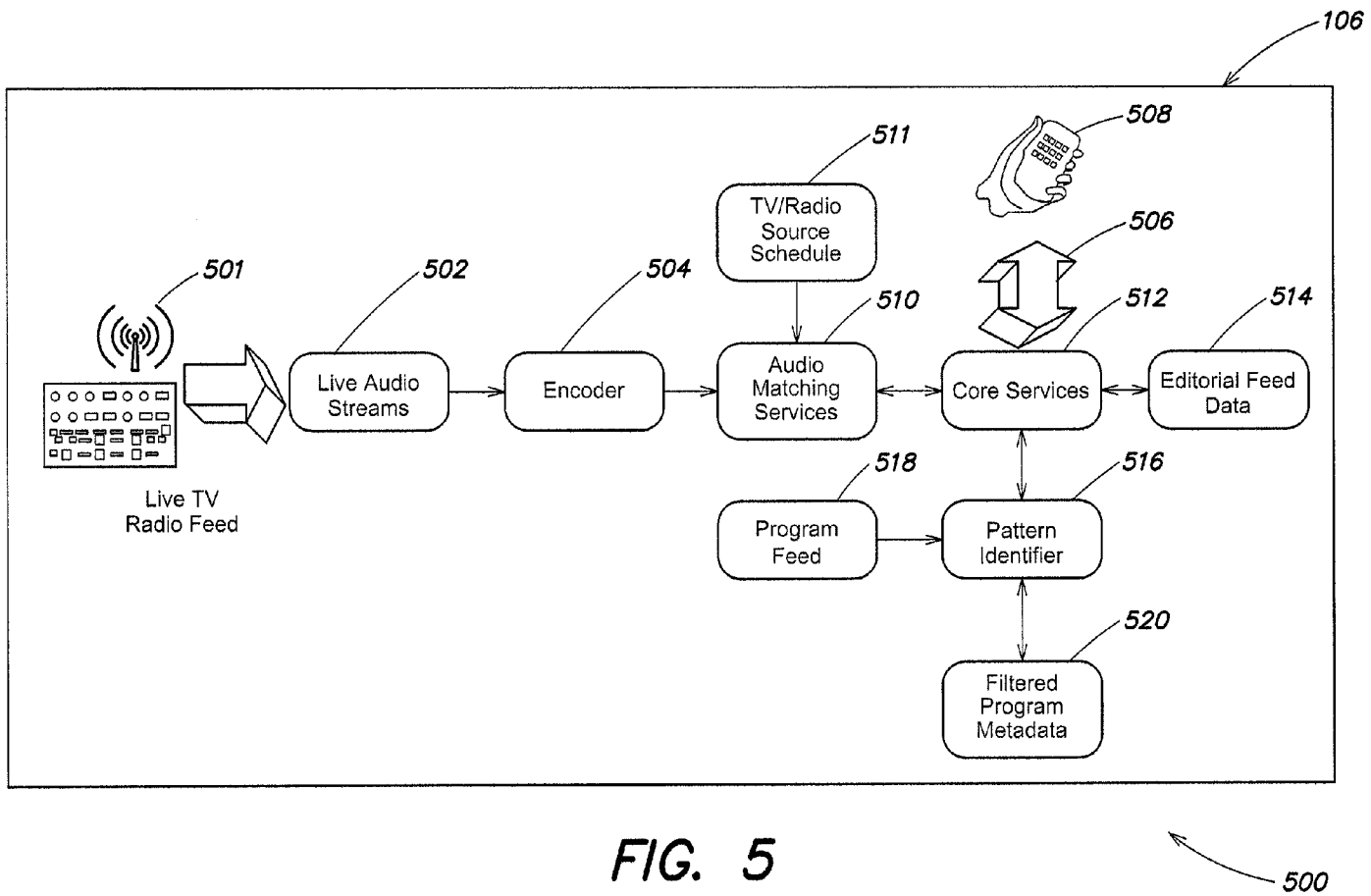
FIG. 5 is a block diagram of a system architecture in accordance with one embodiment of the present invention.

FIG. 5 is a block diagram illustrating the architecture 500 of a system configured to provide a user with specific functionality related to an automatically identified channel and/or program currently being viewed by the user. As discussed above, a matching server 106 receives live TV or Radio audio feeds 502 from known broadcast channels 501.

The matching server 106 includes an encoder module 504 which is configured to encode the received audio feeds 502. According to one embodiment, the audio feed 502 is formatted and encoded as 16 Bit, 22 KHz, mono, Speex signals. However, according to other embodiments, the audio feed may be formatted and encoded in any way.

The matching server 106 also receives an audio feed 506 from an internet enabled device 508. As discussed above, the audio feed 506 includes signals received by the internet enabled device 508 from a broadcast media receiver (e.g., a television or radio) via a microphone.

According to one embodiment, the matching server 106 includes an audio matching services module 510. The audio matching services module 510 receives the audio feed 506 from the internet enabled device 508 and the audio feeds 502 from the known broadcast channels 501. The audio matching services module 510 performs a matching operation between the audio feeds 502, 506, as described above, and identifies the currently being viewed/listened to channel.

According to one embodiment, the audio matching services module 510 also receives schedule information related to the known broadcast channels 501 from a TV/Radio source schedule module 511 (e.g., an EPG). As discussed above, based on the matched channel and the received schedule information, the matching services module 510 identifies a matched program.

According to one embodiment, the matching server 106 also includes a core services module 512. The core services module 512 retrieves matched channel and/or program information from the audio matching services module 510 and provides the matched channel and/or program information to a user via the internet enabled device 508. According to one embodiment, in addition to the identification of the matched channel and/or program, the core services module 512 may provide additional information related to the matched channel and/or program to the user via the internet enabled device 508.

For example, according to one embodiment, in response to the identification of the viewed/listened to channel, the core services module 512 also receives editorial feed data, related to the matched channel or program, from an editorial feed data module 514. For instance, in response to a specific identified matched program, the editorial feed data module 514 can push program specific content or functionality (e.g., polls, sweepstakes, blogs, social media networks, additional program feeds etc) to the user via the internet enabled device 508. Providing program specific content or functionality to a user in response to a matched channel and/or program will be described in greater detail below.

In addition, according to one embodiment, the matching server 106 includes a pattern identifier module 516. The pattern identifier module 516 monitors and keeps track of the matched channels and/or programs viewed by a user. According to one embodiment, the pattern identifier module 516 creates a program history profile (i.e. a viewing or listening history profile) for a specific user. In one embodiment, the program history profile may include such information as the channels viewed or listened to by a user and the programs viewed or listened to by a user over time. In one embodiment, program history profiles related to different users are stored in a database within data storage of the matching server 106. However, in other embodiments, user profiles may be stored in different locations (e.g., external the matching server 106).

According to one embodiment, based on a viewing or listening history profile of a user, the pattern identifier module 516 may provide information to the user which is specifically related to the channel and/or program being viewed/listened to. For example, in one embodiment, based on the profile of a user, the pattern identifier may provide program feeds and/or data 518 which is targeted at users viewing a specific program. For instance, if the pattern identifier module 516 realizes that a user consistently watches a certain program, the pattern identifier module 516 may provide targeted advertisements to the user which are specifically related to the program. In other embodiments, any type of content may be provided to a user based on a user profile.

In another embodiment, based on the profile of a user, the pattern identifier module 516 may provide filtered program metadata 520 to the user via the internet enabled device 508. According to one embodiment, based on the viewing or listening history profile of a user, the pattern identifier module 516 may provide the user with additional program feeds and/or data which the pattern identifier module 516 identifies as potentially of interest to the user.

As discussed above, based on the matching servers 106 identification of the channel and/or program currently being viewed/listened to by a user, specific content or functionality related to the identified channel or program can be provided to the user. FIGS. 6A-6F illustrate different situation in which the matching server 106 may provide content or functionality to a user based on a currently viewed/listened to channel or program. According to one embodiment, the content or functionality provided to a user in response to an automatically identified channel and/or program may be intended to provide incentive for the user to revisit the channel/program, create brand loyalty in the channel/program, provide the user with related information, and/or create a connection between a user and a channel/program in an effort to build a relationship.

Figure 6A:
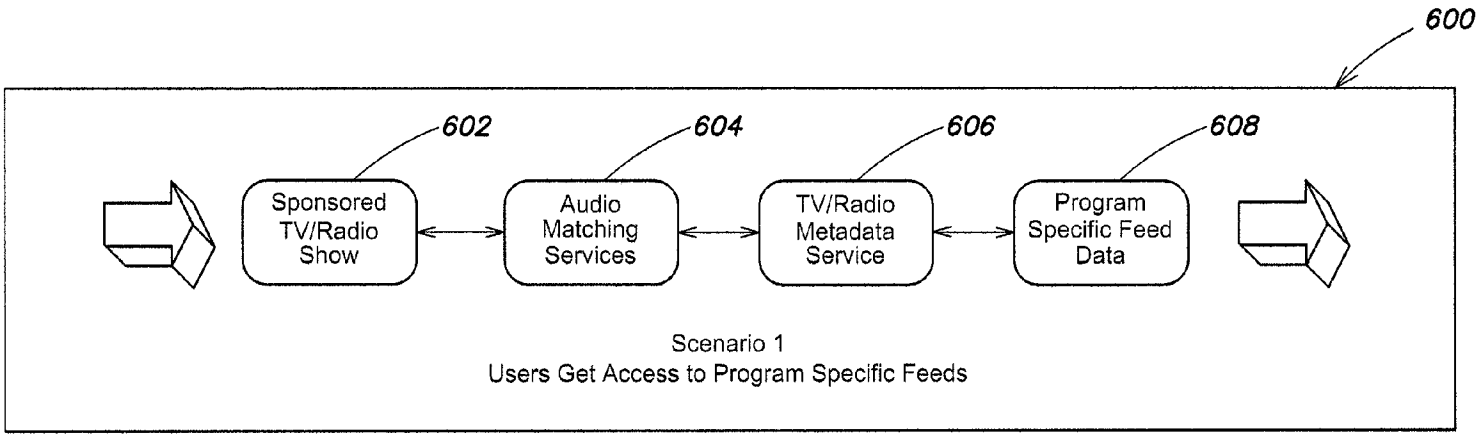
FIG. 6A is a block diagram of a first scenario in which specific content or functionality is provided to a user in accordance with one embodiment of the present invention.

FIG. 6A is a block diagram of a first scenario 600 in which specific content or functionality is provided to a user based on a currently being viewed/listened to channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, in response to the channel and/or program identification, a user may also gain access to specific program and data feeds 608 related to the identified channel and/or program. For example, the specific program and data feeds 608 may provide specific content or functionality related to the identified program or channel. According to some embodiments, this content or functionality may include chats with other users watching or listening to the same program and/or channel, the ability to vote in a poll related to the identified program or the ability to vote/comment on comments by other users, and games related to the identified channel and/or program. However, the channel/program specific content or functionality provided in response to matching may be configured as any appropriate information.

Figure 6B:
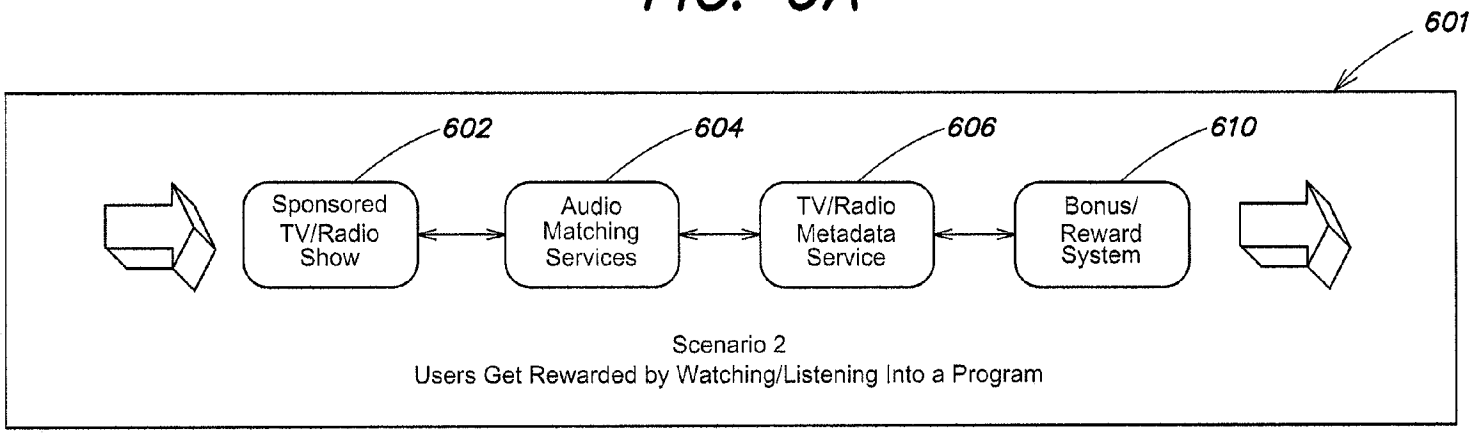
FIG. 6B is a block diagram of a second scenario in which specific content or functionality is provided to a user in accordance with one embodiment of the present invention.

FIG. 6B is a block diagram of a second scenario 601 in which incentives or rewards are provided to a user based on a currently being viewed/listened to channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, in response to the channel and/or program being automatically identified, a user may be automatically rewarded by a bonus/reward system 610 for viewing the identified program and/or channel. For example, once the matching server 106 identifies the program currently being viewed/listened to, the user may be awarded points (e.g., via bonus points, reward points, loyalty points) automatically for their participation. According to one embodiment, the user may be able to trade in awarded points for rewards such as cash, prizes, merchandise, tickets, etc.

In conventional reward-based systems, a user is typically rewarded for taking a specific defined action. For example, a viewer of a television program may receive rewards for logging into an application and manually identifying (i.e., "checking in") which program they are viewing. In another example, a viewer of a television program may receive rewards for responding to a poll via text message. However, in such systems, there is no way for the broadcast provider to confirm that the user is actually viewing or listening to the required program. The broadcast provider must take the word of the user. In addition, in such systems, the user must take an additional step (e.g., "checking-in, texting a response etc.) to be rewarded. In this way, merely viewing or listening to a program is not typically enough to receive rewards.

By automatically identifying the program currently being viewed, without requiring intermediary steps by a user, the user of the current system is able to be rewarded automatically for merely watching or listening to the required program. In addition, by automatically identifying the program being viewed and synching an internet enabled device 104 with the currently being viewed/or listened to broadcast media, the broadcast provider is able to confirm that that the user is actually viewing or listening to the required program, before awarding any incentives.

According to some embodiments, in addition to being rewarded for watching or listening to a specific matched program, a user may also be rewarded for interacting with content or functionality provided to the user in response to the matching server 106 identifying the currently being viewed/listened to channel or program.

In one embodiment, additional rewards can be awarded to the user for actively participating in program specific content or functionality. For example, in response to the currently being viewed/listened channel or program being automatically identified, the user may be provided with content or functionality (e.g., program related chat, game, poll etc.) related to the identified program or channel. In addition to being rewarded for watching/listening to the identified program; a user may be awarded additional or bonus rewards/points for interacting with such content or functionality. For instance, one example of a bonus-point-system bonus point structure is shown in Table 1.

TABLE 1

| | |
|---|---|
| 1 Minute of watching regular shows: | 1 point |
| 1 Minute of watching pilot shows: | 3 points |
| Vote, sweepstakes entry, answer poll questions, like/dislike: | 5 points |
| Register: | 10 points |
| Invite friends: | 25 points per registration |
| Post in chat: | 2 points |
| Comment on post in chat: | 1 point |
| Share post on social network (e.g., Twitter/Facebook: | 5 points |
| Post activities on Facebook-wall or Twitter: | 5 points |
| Purchase affiliate offers: | 500 points |
| Send SMS out of application: | 50 points |
| Sign up for newsletter: | 10 points |

In other embodiments, reward/bonus points may be defined in any way to be issued to a user for any type of interaction with program/channel related activity. As discussed above, a viewing or listening history profile may be generated for a user. In one embodiment, the viewing or listening history profile may track a user's watching/listening habits. In addition, according to one embodiment, the viewing or listening history profile of a user may be provided to the bonus/reward system 610 to be associated with appropriate reward/bonus points. A viewing or listening history profile with associated bonus points may be stored for a user in order to incentivize the user to continue to watch/follow certain channels or programs.

Figure 6C:
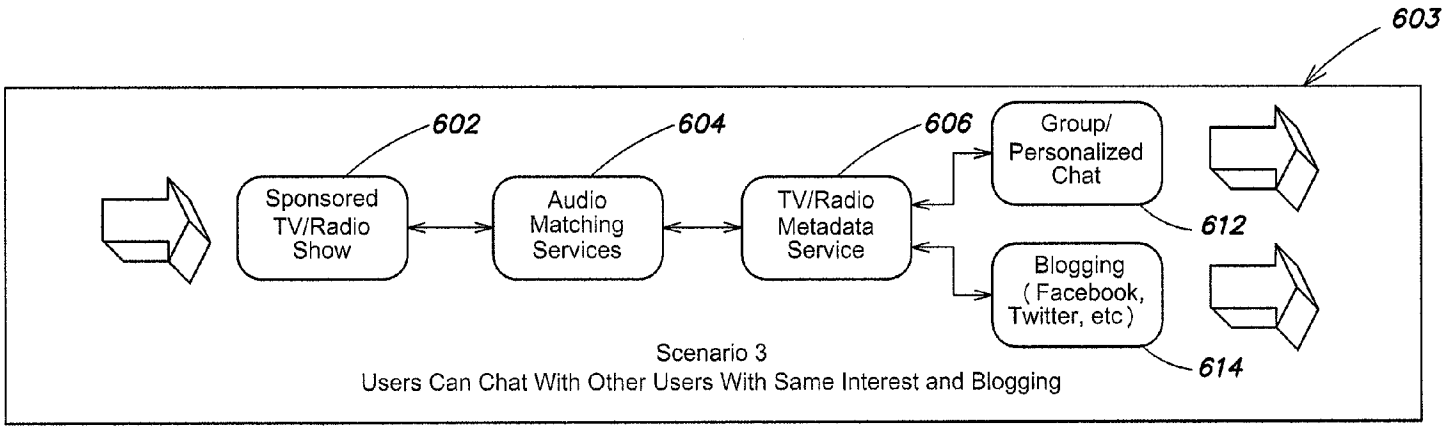
FIG. 6C is a block diagram of a third scenario in which specific content or functionality is provided to a user in accordance with one embodiment of the present invention.

FIG. 6C is a block diagram of a third scenario 603 in which a user is automatically provided the opportunity to chat with other users having similar interests (e.g., watching or listening to the same program), based on a currently being viewed/listened to channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, in response to the channel and/or program being automatically identified, a user may automatically be provided an interface to interact with other users who are also watching/viewing the same channel or program.

For example, according to one embodiment, in response to the channel and/or program identification, a user is automatically provided a social media network interface 614 to interact with other users, watching or listening to the same program, via a social media network (e.g., Facebook, Twitter, Myspace, blogs, etc.) According to some embodiments, using a social media network, a user may indicate which channel or show they are currently watching or listening to, post comments related to the commonly viewed channel or program, vote in polls on the social media network related to the commonly viewed channel or program, comment on other users comments related to the commonly viewed channel or program, and/or indicate whether they like or dislike a comment by another user related to the commonly viewed channel or program.

According to another embodiment, in response to the channel and/or program identification a user is automatically provided a chat interface 612 to interact with other users watching or listening to the same program. According to one embodiment, users are directed into chat groups matching the program and/or channel that they are currently watching or listening to. Using the chat interface 612, users who are watching the same program or channel can actively exchange information about the program or channel with each other in real time.

According to one embodiment, users in a chat group have the option to agree or disagree (like or dislike) with statements/actions other users wrote/took. In this way, a user can share his opinion about certain topics or believes of other users. According to one embodiment, whether a user agrees of disagrees (likes or dislikes) with another user's statements or actions is displayed adjacent to the other user's statements or actions in the form of a short sentence. For example, if user X agrees with a comment posted by another user in relation to the program currently being watched, "X agrees with this" or "X likes this" will be displayed. In one embodiment, the chat interface 612 keeps track of how many people agree or disagree with each comment or action. According to one embodiment, the number of agrees/disagrees triggers a certain action. For example, in one embodiment, as soon as a comment made by a user in a chat receives a pre-defined number of agrees, it is automatically posted to a social network.

In conventional chat groups, it is a common problem that a chat group may become overcrowded. For instance, too many users may be in the same chat room, making meaningful discussion difficult. For example, due to a large number of posters, a post of a single user may not remain visible long enough for it to be read in detail. Therefore, according to one embodiment of the current invention, the chat interface 612 may include an auto-grouping system.

According to one embodiment, an auto-grouping system includes a mechanism to place a user into an appropriately sized chat group that allows for meaningful discussion. Placement of the user into a group is dependent on criteria enabling groups of appropriate size and relevant discussion. For example, the auto-grouping system may be based on an auto-grouping framework. According to one embodiment, this framework comprises three components: 1. Television/Radio Show, 2. Relationship (friend-status), 3. Geographical data. However, in other embodiments, an auto-grouping framework may include any number or type of components.

According to one embodiment, the Television/Radio show component is the television or radio show identified by the matching server 106, as described above. By matching people together who are viewing or listening to the same program, discussion related to the common subject matter of the television or radio show may be fostered.

According to another embodiment, the Relationship component includes friends of the user. In one embodiment, friends of the user are extracted from social media networks (e.g., Facebook, Twitter, Myspace, or other social networking groups). According to one embodiment, in addition to direct friends, indirect friends (i.e. friends of friends) are also extracted. By matching users together who are friends, discussion may be more comfortable in that oftentimes, people are more at east talking to their friends, rather than strangers.

According to one embodiment, the Geographical data component includes the location of the user. In one embodiment, the location of the user may be determined by analyzing the IP address of the internet enabled device 104. According to one embodiment, the chat interface calculates a "distance" between potential chat partners based on the geographical data. By matching users together who are in a similar geographic location, discussion may be more meaningful as generally, people who live in the same geographic area have more in common.

In one embodiment, the chat interface 612 may automatically provide a chat group to a user based on at least one of the above mentioned components. In one embodiment, the chat interface 612 automatically groups a user based on all three components. For example, the chat interface 612 may group the user into a chat room that includes users who are watching the same program, are friends in a social media network and who live in the same area. In other embodiments, the three components may be used in any combination. For example, in one embodiment, component one may be utilized while components two and three are optional. In another embodiment, components two and three may be utilized while component three is optional.

According to one embodiment, in addition to the three components identified above, the chat interface 612 may also analyze additional information when grouping users into chat rooms. For example, in one embodiment, additional information such as the interests, hobbies, favorite shows, and desired topics of conversation etc. of the user may be used when making groping decisions.

Figure 7:
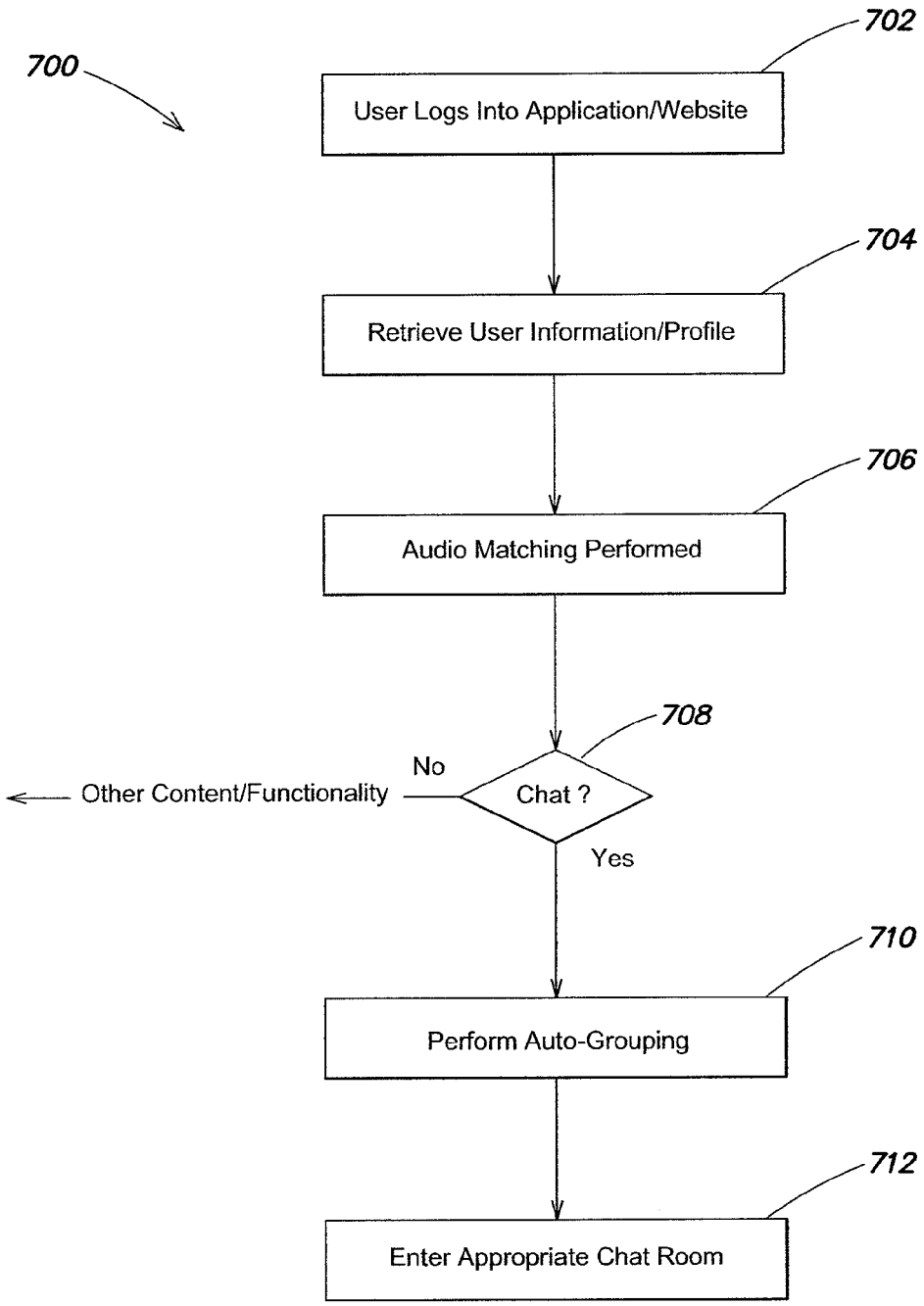
FIG. 7 is a flow chart of an auto-grouping process in accordance with one embodiment of the present invention.

FIG. 7 illustrates an auto-grouping process 700 according to aspects of the present invention. At block 702, a user initiates the audio matching/synchronization process described above. In one embodiment, initiating the audio matching/synchronization process requires the user to log in using a username and password. At block 704, in response to the user logging in, associated information, related to the user, is retrieved from a user profile stored in a database of the data storage of the matching server 106. As described above, a user profile may include viewing/listening history information (e.g., commonly viewed or listened to channels or shows). In one embodiment, a user profile may also include such information as geographic information (i.e. an address), relationship information (i.e. friends from social media networks), interests of the user, hobbies of the user, or any other appropriate information.

At block 706, the audio matching process, as described above, is performed to automatically identify the currently viewed or listened to channel and/or program. At block 708, after identifying the viewed channel or program, a user is queried whether they would like to participate in a chat related to the identified channel and/or program. In response to a determination that the user would not like to participate in a chat, other content/functionality related to the identified channel or program may be provided to the user. In response to a determination that the user would like to participate in a chat, at block 710, an auto-grouping function is performed to automatically assign the user to an appropriate chat room based on the user profile. According to another embodiment, the auto-grouping function is performed automatically in response to the identification of the currently viewed or listened to channel and/or program and a user is automatically assigned to an appropriate chat room.

According to one embodiment, the auto-grouping function may be performed in any number of ways and may utilize any number of information combinations. For example, according to one embodiment, users who are watching/listening to the same program or channel may be grouped first by friends, then by friends of friends and finally by neighbors. In another embodiment, users who are watching/listening to the same program or channel may be grouped first with other users with similar interests, then with friends, then with neighbors. In another embodiment, users who are watching/listening to the same program or channel may be grouped first with users with similar genre interests (e.g., action, romance, comedy, sports, etc.), then with friends, then with neighbors.

According to one embodiment, users who are watching/listening to the same program or channel may be grouped with other users based, at least partially, on the user's activity time. For example, in the event that a user typically views the identified program at a certain time, the user may be grouped with people also viewing the program at the same time.

According to another embodiment, users who are watching/listening to the same program or channel may be grouped first by their demographics (e.g., age, household, education, income, etc.), second with friends and third by neighbors. In another embodiment, users who are watching/listening to the same program or channel may be grouped based on interests identified in their user profiles (e.g., same social media network groups, agree (like) the same comments, similar hobbies etc.).

According to one embodiment, users who are watching/listening to the same program or channel may be grouped based on their activity within the chat interface 612. For example, users who are very active in chat rooms are grouped with less active users, creating homogeneous groups.

In addition to the different components and parameters identified above, the chat interface 612 may also perform auto-grouping to reach a pre-defined optimal target group size. In one embodiment, the group size is selected so that there are enough users to generate a comment at least every fifteen seconds, but not so many users as to generate a comment more often than every five seconds. However, in other embodiments, the minimum and maximum time limits between comments may be configured differently.

According to one embodiment, the group size is limited to a certain number of users. For example, in one embodiment, the number of users is static and not dependent on the activity within the group. In such an embodiment, when the maximum number of users is reached, no additional users will be allowed to enter the group. In one embodiment, despite being at maximum capacity, a special rule may allow special members (e.g., close friends of users already participating in the group, group administrators, group ambassadors, etc.) to join the group and enlarge the group despite the size limitation.

According to other embodiments, the group size is not automatically limited to a certain number of users. For example, in some embodiments, the group size may be limited by the lengths of comments made by users within the group. For instance, if user comments consist of a certain number of characters which imply the conversation to be a high quality conversation, the number of group members may be limited to a small number to allow the conversation to remain at a high quality.

Upon performing auto-grouping, including determining which chat groups a user should be a member of and how large each group should be, at block 712 the user enters the identified chat room corresponding to the currently being viewed/listened to program and the appropriate criteria.

Figure 6D:
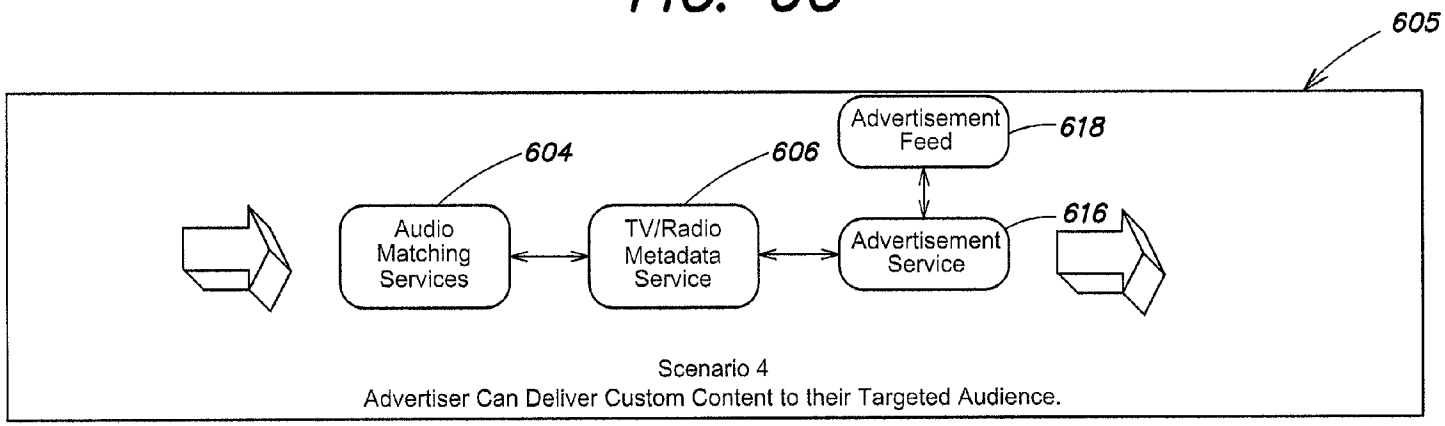
FIG. 6D is a block diagram of a fourth scenario in which specific content or functionality is provided to a user in accordance with one embodiment of the present invention.

FIG. 6D is a block diagram of a fourth scenario 605 in which a user is automatically delivered advertiser content based on an automatically identified channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, in response to the channel and/or program being automatically identified, a user may automatically be provided an advertisement feed and/or data 618 via an advertisement service module 616.

According to one embodiment, the advertisement service module 616 provides the user with advertisement content specifically related to the identified channel or program. For example, in one embodiment, the advertisement service module 616 provides to the user an advertisement for a product featured in an identified program (e.g., a shirt worn by an actor, shoes worn by an actress etc.) In another embodiment, the advertisement service module 616 provides to the user an advertisement for products related to the identified program (e.g., an advertisement for athletic equipment while watching a sporting event). In another embodiment, the advertisement service module 616 provides to the user an advertisement related to the identified program (e.g., an advertisement for upcoming show times or an advertisement from the producer of the identified program to introduce another program). According to other embodiments, any type of advertisement related to the identified channel or program may be presented to the user.

Figure 6E:
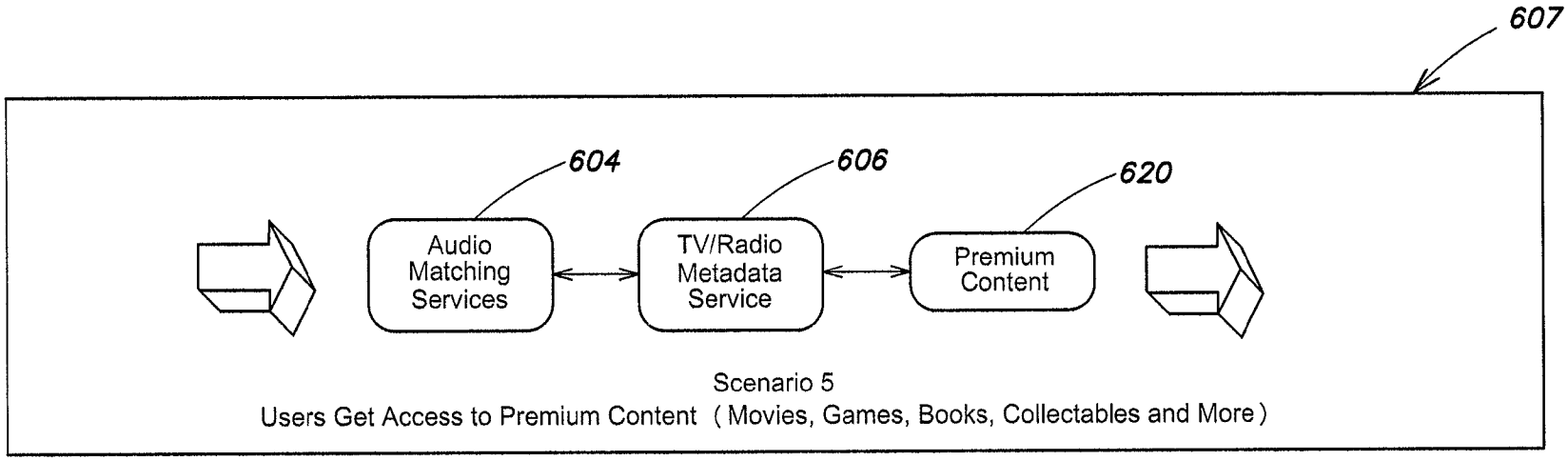
FIG. 6E is a block diagram of a fifth scenario in which specific content or functionality is provided to a user in accordance with one embodiment of the present invention.

FIG. 6E is a block diagram of a fifth scenario 607 in which a user is automatically delivered premium content 620 based on an automatically identified channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, in response to the channel and/or program being automatically identified, user may automatically be provided premium content 620 related to the identified channel and/or program.

According to one embodiment, premium content 620 includes games, play-along videos or polls related to the identified channel and/or program. For example, such games, play-along videos or polls may allow a user to play along with quiz shows or game shows, to bet on the outcome of sports events, to vote on members of a casting show, to respond to a show related poll, to play a video based game etc. By automatically identifying the channel or program that the user is watching or listening to and automatically providing the user with game, video or poll information, the game, video or poll is provided to the user in real time. In this way, the user is capable of being provided options at substantially the same time as a related event is occurring in the broadcast program. For example, if a user is currently watching a game show in which a contestant on the game show is presented with a multiple choice question and a matching server 106 has automatically identified, via audio signals from an internet enabled device 104, that the user is currently watching the game show, the user may be presented the same multiple choice question as the contestant. According to one embodiment, the user may be provided an incentive (e.g., bonus points, reward points, promotional gifts, discounts, monetary prizes, etc.) for playing along with a game and/or winning the game.

Figure 6F:
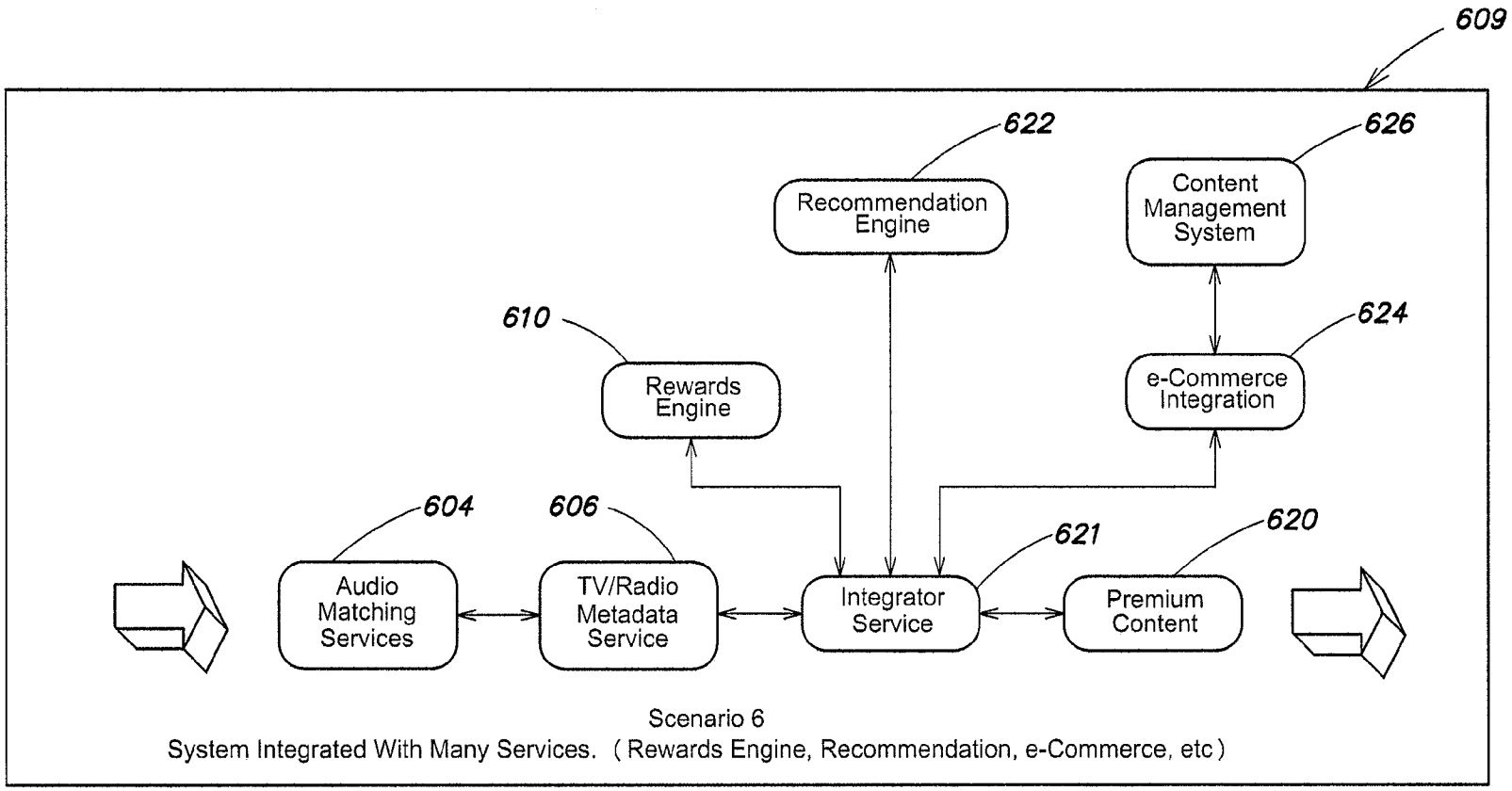
FIG. 6F is a block diagram of a sixth scenario in which specific content or functionality is provided to a user in accordance with one embodiment of the present invention.

FIG. 6F is a block diagram of a sixth scenario 609 in which a user is automatically delivered integrated content from an integrator service module 621 based on an automatically identified channel or program. The audio matching services module 604 matches audio signals received by an internet enabled device with audio signals from a known broadcast channel currently being broadcast in order to identify the channel and/or program currently being viewed or listened to. As discussed above, in response to the channel and/or program identification, a user may be provided information related to the channel and/or program (e.g., name, synopsis, cast, crew, or any other information retrieved from a TV/Radio Metadata Service 606). In addition, according to one embodiment, the integrator service module 621 may combine content or functionality, related to the identified channel or program, from any number of sources and provide the content or functionality to the user. For example, in one embodiment, the integrator service module 621 may provide the user with reward/bonus information from a reward engine 610 (as discussed above) in addition to premium content 620 (as discussed above).

In another embodiment, the integrator service module 621 also provides information from a content management system 626, such as an advertisement service module 616 as described above, in response to the identified channel or program. In one embodiment, in addition to providing advertisement information to the user, the integrator service module 621 also communicates with an e-commerce integration module 624. The e-commerce integration module 624 may allow a user to actually make online purchases of products which are featured in the advertisement information. For example, an advertisement for a product featured in a television show may be displayed to the user in response to an automatic identification of the television show. In response, the user may be able to directly purchase the product via the e-commerce integration module 624.

According to one embodiment, the integrator service module 621 also provides information to the user from a recommendation engine 622. In one embodiment, the recommendation engine 622 provides content/functionality/program information (e.g., recommend programs, chat rooms, informational pages, games, polls, etc.) to a user based on the automatically identified channel or program currently being viewed/listened to by the user and/or additional information about the user. In one embodiment, recommendations by the recommendation engine 622 may be based on user data extracted from a social media network, user data extracted from a registration form, user behavior extracted from a user profile, comments made by a user, posts designated as being agreed on/liked, pages visited, or any other information related to the user.

Various embodiments according to the present invention may be implemented on one or more computer systems or other devices capable of automatically identifying a channel and/or program as described herein. A computer system may be a single computer that may include a minicomputer, a mainframe, a server, a personal computer, or combination thereof. The computer system may include any type of system capable of performing remote computing operations (e.g., cell phone, PDA, set-top box, or other system). A computer system used to run the operation may also include any combination of computer system types that cooperate to accomplish system-level tasks. Multiple computer systems may also be used to run the operation. The computer system also may include input or output devices, displays, or storage units. It should be appreciated that any computer system or systems may be used, and the invention is not limited to any number, type, or configuration of computer systems.

These computer systems may be, for example, general-purpose computers such as those based on Intel PENTIUM-type processor, Motorola PowerPC, Sun UltraSPARC, Hewlett-Packard PA-RISC processors, or any other type of processor. It should be appreciated that one or more of any type computer system may be used to partially or fully automate play of the described game according to various embodiments of the invention. Further, the software design system may be located on a single computer or may be distributed among a plurality of computers attached by a communications network.

Figure 8:
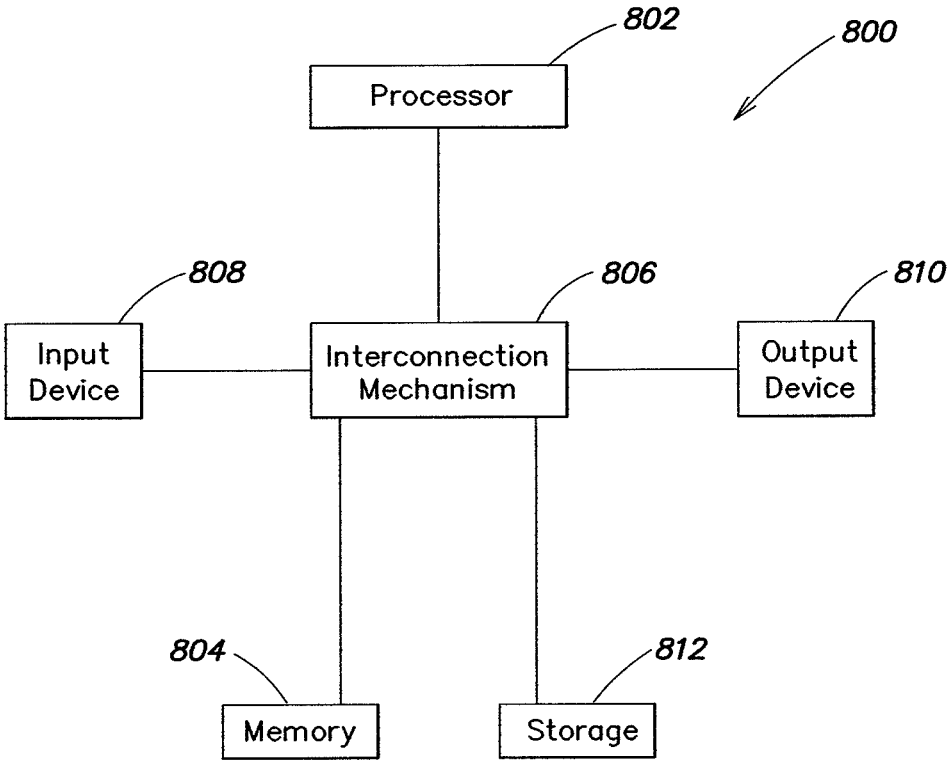
FIG. 8 is a block diagram of a general-purpose computer system upon which various embodiments of the invention may be implemented.

For example, various aspects of the invention may be implemented as specialized software executing in a general-purpose computer system 800 such as that shown in FIG. 8. The computer system 800 may include a processor 802 connected to one or more memory devices 804, such as a disk drive, memory, or other device for storing data. Memory 804 is typically used for storing programs and data during operation of the computer system 800. Components of computer system 800 may be coupled by an interconnection mechanism 806, which may include one or more busses (e.g., between components that are integrated within a same machine) and/or a network (e.g., between components that reside on separate discrete machines). The interconnection mechanism 806 enables communications (e.g., data, instructions) to be exchanged between system components of system 800. Computer system 800 also includes one or more input devices 808, for example, a keyboard, mouse, trackball, microphone, touch screen, and one or more output devices 810, for example, a printing device, display screen, and/or speaker. In addition, computer system 800 may contain one or more interfaces (not shown) that connect computer system 800 to a communication network (in addition or as an alternative to the interconnection mechanism 806.

Figure 9:
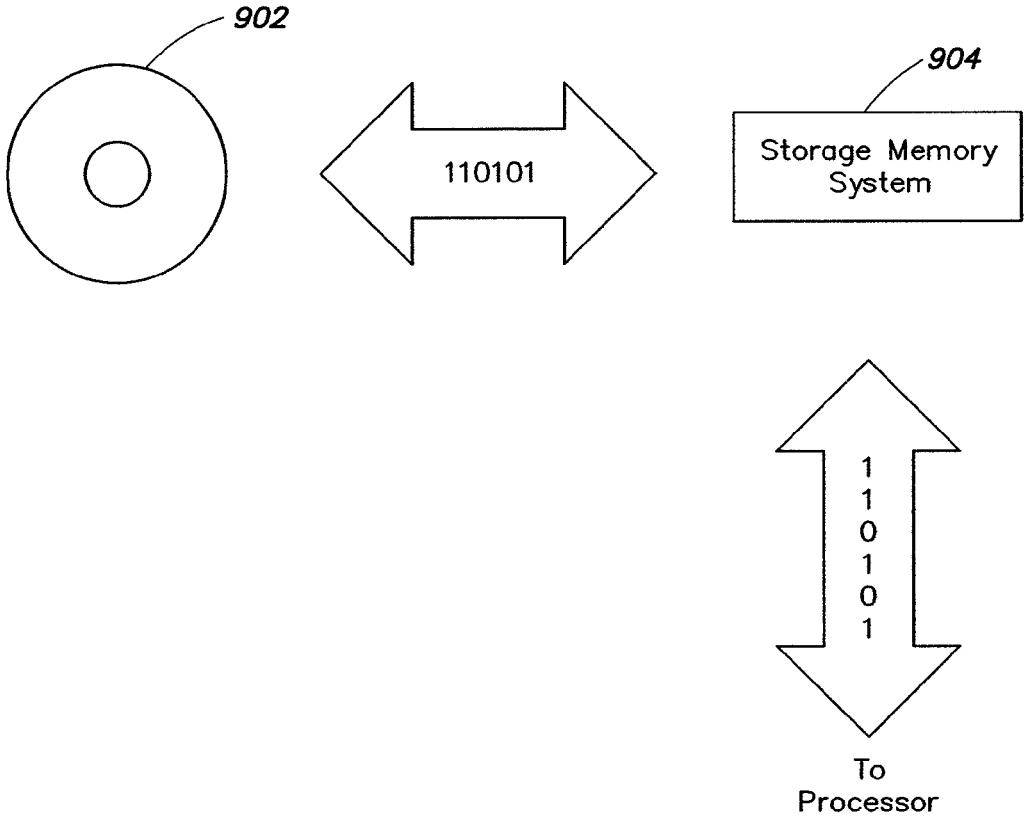
FIG. 9 is a block diagram of a computer data storage system with which various embodiments of the invention may be practiced

The storage system 812, shown in greater detail in FIG. 9, typically includes a computer readable and writeable nonvolatile recording medium 902 in which signals are stored that define a program to be executed by the processor or information stored on or in the medium 902 to be processed by the program. The medium may, for example, be a disk or flash memory. Typically, in operation, the processor causes data to be read from the nonvolatile recording medium 902 into another memory 904 that allows for faster access to the information by the processor than does the medium 902. This memory 904 is typically a volatile, random access memory such as a dynamic random access memory (DRAM) or static memory (SRAM). It may be located in storage system 812, as shown, or in memory system 804. The processor 802 generally manipulates the data within the integrated circuit memory 804, 904 and then copies the data to the medium 902 after processing is completed. A variety of mechanisms are known for managing data movement between the medium 902 and the integrated circuit memory element 804, 904, and the invention is not limited thereto. The invention is not limited to a particular memory system 804 or storage system 812.

The computer system may include specially-programmed, special-purpose hardware, for example, an application-specific integrated circuit (ASIC). Aspects of the invention may be implemented in software, hardware or firmware, or any combination thereof. Further, such methods, acts, systems, system elements and components thereof may be implemented as part of the computer system described above or as an independent component.

Although computer system 800 is shown by way of example as one type of computer system upon which various aspects of the invention may be practiced, it should be appreciated that aspects of the invention are not limited to being implemented on the computer system as shown in FIG. 8. Various aspects of the invention may be practiced on one or more computers having a different architecture or components that that shown in FIG. 8.

Computer system 800 may be a general-purpose computer system that is programmable using a high-level computer programming language. Computer system 800 may be also implemented using specially programmed, special purpose hardware. In computer system 800, processor 802 is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME), Windows XP, or Windows Visa operating systems available from the Microsoft Corporation, MAC OS System X available from Apple Computer, the Solaris Operating System available from Sun Microsystems, or UNIX available from various sources. Many other operating systems may be used.

The processor and operating system together define a computer platform for which application programs in high-level programming languages are written. It should be understood that the invention is not limited to a particular computer system platform, processor, operating system, or network. Also, it should be apparent to those skilled in the art that the present invention is not limited to a specific programming language or computer system. Further, it should be appreciated that other appropriate programming languages and other appropriate computer systems could also be used.

One or more portions of the computer system may be distributed across one or more computer systems (not shown) coupled to a communications network. These computer systems also may be general-purpose computer systems. For example, various aspects of the invention may be distributed among one or more computer systems configured to provide a service (e.g., servers) to one or more client computers, or to perform an overall task as part of a distributed system. For example, various aspects of the invention may be performed on a client-server system that includes components distributed among one or more server systems that perform various functions according to various embodiments of the invention. These components may be executable, intermediate (e.g., IL) or interpreted (e.g., Java) code which communicate over a communication network (e.g., the Internet) using a communication protocol (e.g., TCP/IP).

It should be appreciated that the invention is not limited to executing on any particular system or group of systems. Also, it should be appreciated that the invention is not limited to any particular distributed architecture, network, or communication protocol. Various embodiments of the present invention may be programmed using an object-oriented programming language, such as SmallTalk, Java, C++, Ada, or C#

(C-Sharp). Other object-oriented programming languages may also be used. Alternatively, functional, scripting, and/or logical programming languages may be used. Various aspects of the invention may be implemented in a non-programmed environment (e.g., documents created in HTML, XML or other format that, when viewed in a window of a browser program, render aspects of a graphical-user interface (GUI) or perform other functions). Various aspects of the invention may be implemented as programmed or non-programmed elements, or any combination thereof.

As described above, the matching server 106 is configured to receive live audio feeds from the internet enabled device 104 and the known broadcast channels. However, in other embodiments, the matching server 106 may also operate on time shifted feeds. For instance, in conventional television or radio systems, a user may be able to record programs for later viewing (i.e. time shift the program). When the user later selects the program for viewing; comparing the time shifted audio feed received by the internet enabled device 104 to live audio feeds received from known broadcast channels may not yield an accurate matching process.

Therefore, according to one embodiment, the matching server 106 archives audio feeds received from the known broadcast channels. In this way, when a user views/listens to a time shifted program, the audio signals received by the internet enabled device 104 may be compared to the archived audio feeds to determine the currently being viewed program. In one embodiment, in order to ensure accurate synchronization between the internet enabled device 104 and the matching server 106, the archived audio feeds may be tagged with program metadata (e.g., information about the program, advertisement information, time/date information etc.). By comparing the received audio signals from the internet enabled device 104 with the archived audio feeds and the tagged metadata related to the archived feeds, the matching server 106 is able to accurately synchronize the internet enabled device 104 to the correct program and provide appropriate content and functionality as described above.

As described above, an internet enabled device 104 is described as communicating with a single matching server 106. However, in other embodiments, the internet enabled device 104 may be configured to communicate with a plurality of matching servers 106. In this way, the workload of receiving audio feeds from known broadcast channels may be distributed amongst multiple matching servers 106.

As described above, a matching server 106 is configured to automatically identify a currently being viewed/listened to channel or program by a user and provide content/functionality related to the identified channel/program. However, in other embodiments, a user may be able to manually identify the program/channel he is watching or listening to. In response to the manual identification, related content or functionality may be provided to the user as discussed above.

As described herein, by automatically identifying a currently being viewed/listened to channel or program via audio matching, an intermediary step required by a user (e.g., a checking in or logging in step) is eliminated. In addition, by not requiring an intermediary action be taken by a user, the user is able to be directly linked to the received broadcast media and to directly interact with the broadcast media. For example, upon automatically identifying the program or channel currently being viewed or listened to by a user, the user may immediately be provided with program/channel specific content or functionality, allowing the user to directly interact with the program or channel. By automatically providing the user with specific content related to what the user is currently viewing or listening to, the content or functionality provided to the user is able to be automatically directed specifically at the interests of the user, potentially creating a deeper relationship between the user and the program.

In addition, it is to be appreciated that by providing a dual device system (i.e. a "two-screen system") instead of a fully integrated system, the current invention may be mobile. For example, according to some embodiments, the internet enable device 104 is not physically coupled to the matching server 106 and instead, may be located adjacent any broadcast receiving device 102 which is currently receiving broadcast media signals and which is providing audio signals, as long as the internet enabled device is able to communicate with the matching server 106 (e.g., via the internet). Therefore, a user may move from broadcast receiving device to broadcast receiving device (e.g., from TV to TV) and the matching server 106 will perform the matching process accordingly.

Having thus described several aspects of at least one embodiment of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

What is claimed is:

1. A method for awarding incentives, the method comprising:

receiving, by a server, audio signals record ed by a user device over a communication network;

receiving, by the server, audio signals from a plurality of broadcast channels over the communication network;

comparing, by a processor in the server, the audio signals received from the user device and the audio signals received from the plurality of broadcast channels;

determining, by the processor, based on the act of comparing, that the audio signals from the user device correspond to audio signals broadcast on a particular one of the plurality of broadcast channels;

processing, by the processor, schedule information to determine a program currently being broadcast on the particular broadcast channel; and in response to the act of processing, automatically awarding, by the processor, at least one incentive to a user of the user device for perceiving the program currently being broadcast.

2. The method of claim 1, further comprising tracking, based on the act of determining, a program history of the user.

3. The method of claim 2, further comprising generating, based on the act of tracking, a program history profile corresponding to the user.

4. The method of claim 3, wherein the act of awarding further comprises awarding incentives to the user based on the user's program history profile.

5. The method of claim 1, further comprising awarding, by the processor, bonus incentives to the user in response to the user interacting with the program currently being broadcast.

6. The method of claim 5, wherein the act of awarding bonus incentives includes awarding bonus incentives to the user in response to the user participating in a chat related to the program currently being broadcast, and wherein the user is grouped into a chat group based on a grouping criteria.

7. The method of claim 5, wherein the act of awarding bonus incentives includes awarding bonus incentives to the user in response to the user making a comment in a social media network related to the program currently being broadcast.

8. The method of claim 5, wherein the act of awarding bonus incentives includes awarding bonus incentives to the user in response to the user participating in a poll related to the program currently being broadcast.

9. A system for awarding incentives, the system comprising:

a server comprising:

a first interface configured to be coupled to a communication network and to receive audio signals recorded by a user device over the communication network;

a second interface configured to be coupled to the communication network and to receive audio signals from a plurality of broadcast channels over the communication network; and a processor coupled to the first interface and the second interface, wherein the processor is configured to associate the audio signals from the user device with audio signals being broadcast on a particular one of the plurality of broadcast channels, process schedule information to determine a program currently being broadcast on the particular broadcast channel, and in response, automatically award at least one incentive to a user of the user device for perceiving the program currently being broadcast.

10. The system of claim 9, wherein the at least one incentive is at least one reward point capable of being redeemed by the user toward an award.

11. The system of claim 9, wherein the processor is further configured to automatically track an amount of time that the first interface is receiving audio signals from the user device associated with the program currently being broadcast and to automatically award a corresponding incentive to the user in response to the amount of time.

12. The system of claim 9, wherein the processor is further configured to award at least one incentive to the user device in response to the user interacting with the program currently being broadcast.

13. The system of claim 9, further comprising a data storage coupled to the processor, the data storage configured to maintain a database including a profile associated with the user, wherein the profile includes a program history associated with the user.

14. The system of claim 13, wherein the profile also includes incentive information related to the user.

15. A non-transitory computer readable medium comprising computer-executable instructions that when executed on a processor causes an apparatus at least to preform:

receiving audio signals recorded by a user device over a communication network;

receiving audio signals from a plurality of broadcast channels over the communication network;

comparing the audio signals received from the user device and the audio signals received from the plurality of broadcast channels;

determining, based on the act of comparing, that the audio signals from the user device correspond to audio signals broadcast on a particular one of the plurality of broadcast channels;

processing schedule information to determine a program currently being broadcast on the particular broadcast channel; and in response to the act of determining, automatically awarding at least one incentive to a user of the user device for perceiving the program currently being broadcast.

16. The computer readable medium according to claim 15, wherein the computer-executable instructions, when executed on the processor, further cause the apparatus to track, based on the act of determining, a program history of the user.

17. The computer readable medium according to claim 16, wherein the computer-executable instructions, when executed on the processor, further cause the apparatus to generate, based on the act of tracking, a program history profile corresponding to the user.

18. The computer readable medium according to claim 17, wherein the act of awarding further comprises awarding incentives to the user based on the user's program history profile.

19. The computer readable medium according to claim 15, wherein the computer-executable instructions, when executed on the processor, further cause the apparatus to award bonus incentives to the user in response to the user interacting with the program currently being broadcast.

20. The computer readable medium according to claim 19, wherein the act of awarding bonus incentives includes awarding bonus incentives to the user in response to an amount time that the first interface is receiving audio signals from the user corresponding to the program currently being broadcast.

* * * * *